US012668339B2

(12) United States Patent
Hong et al.

(10) Patent No.: US 12,668,339 B2
(45) Date of Patent: Jun. 30, 2026

(54) PORT MONITORING SYSTEM

(71) Applicant: HWASEUNG CORPORATION CO., LTD., Busan (KR)

(72) Inventors: Seung Pyo Hong, Busan (KR); Jin Min Youn, Busan (KR); Sang Su Bae, Busan (KR); Yu Jin Jo, Busan (KR); Jin Hyung Park, Busan (KR); Nam Woo Kim, Gyeongju-si (KR)

(73) Assignee: HWASEUNG CORPORATION CO., LTD., Busan (KR)

( * ) Notice: Subject to any disclaimer, the term of this patent is extended or adjusted under 35 U.S.C. 154(b) by 113 days.

(21) Appl. No.: 18/621,205

(22) Filed: Mar. 29, 2024

(65) Prior Publication Data

US 2024/0351671 A1 Oct. 24, 2024

(30) Foreign Application Priority Data

Apr. 19, 2023 (KR) ..... 10-2023-0051054
Nov. 22, 2023 (KR) ..... 10-2023-0163453
Jan. 2, 2024 (KR) ..... 10-2024-0000431

(51) Int. Cl.
*B63B 79/10* (2020.01)
*B63B 59/02* (2006.01)
*B63B 79/40* (2020.01)

(52) U.S. Cl.
CPC ..... *B63B 79/10* (2020.01); *B63B 59/02* (2013.01); *B63B 79/40* (2020.01)

(58) Field of Classification Search
CPC ..... B63B 79/10; B63B 59/02; B63B 79/40; B63B 2213/00; G06Q 10/063
See application file for complete search history.

(56) References Cited

U.S. PATENT DOCUMENTS

2014/0132452 A1* 5/2014 DeAngelis ..... G01S 5/0018 342/451
2015/0158564 A1* 6/2015 Miyamoto ..... G01C 21/203 340/985

FOREIGN PATENT DOCUMENTS

GB 2495374 A * 4/2013 ..... E02B 3/26
JP H1040500 A * 2/1998 ..... B63B 49/00
JP 2019169194 A * 10/2019 ..... G08G 1/00
JP 2022082912 A * 6/2022 ..... Y02A 90/10
KR 10-0175350 B1 4/1999

(Continued)

OTHER PUBLICATIONS

GB2495374 copy with Line Numbers appended (Year: 2013).*

(Continued)

*Primary Examiner* — Joan T Goodbody
*Assistant Examiner* — Rafael Velasquez Vanegas
(74) *Attorney, Agent, or Firm* — Revolution IP, PLLC

(57) ABSTRACT

A port monitoring system including: a port environment detection unit in which it is important to monitor the accurate position and posture of ships, especially large ships, in a port (or harbor), and which monitors the position and status of fenders in the port, and measures the environmental conditions of the port and thus generates port environment information to integrally manage ships and fenders in order to efficiently manage the port; a ship monitoring unit which is included in a ship and generates ship information of the ship; a fender monitoring unit which is included in a fender and generates fender information of the fender; a network; and a port management unit.

8 Claims, 19 Drawing Sheets

(56) References Cited

FOREIGN PATENT DOCUMENTS

| | | | | | |
|---|---|---|---|---|---|
| KR | 10-2004-0013197 | A | | 2/2004 | |
| KR | 10-2004-0077194 | A | | 9/2004 | |
| KR | 10-2010-0008499 | A | | 1/2010 | |
| KR | 10-2012-0017837 | A | | 2/2012 | |
| KR | 10-2014-0089628 | A | | 7/2014 | |
| KR | 10-2015-0075143 | A | | 7/2015 | |
| KR | 10-1583631 | B1 | | 1/2016 | |
| KR | 10-2018-0046465 | A | | 5/2018 | |
| KR | 10-1904092 | B1 | | 10/2018 | |
| KR | 10-2018-0136288 | A | | 12/2018 | |
| KR | 101938817 | B1 | * | 1/2019 | ..... E02B 3/066 |
| KR | 20190101275 | A | * | 8/2019 | ..... G08G 3/02 |
| KR | 10-2044868 | B1 | | 11/2019 | |
| KR | 10-2074461 | B1 | | 3/2020 | |
| KR | 10-2265980 | B1 | | 6/2021 | |
| KR | 10-2021-0090574 | A | | 7/2021 | |
| KR | 10-2021-0147619 | A | | 12/2021 | |
| WO | 2008-053887 | A1 | | 5/2008 | |
| WO | WO-2008084902 | A1 | * | 7/2008 | ..... G01S 1/68 |

OTHER PUBLICATIONS

JP2019169194 EPO Translation with Paragraph Numbers (Year: 2019).*

JP2022082912A EPO Translation with Paragraph Numbers (Year: 2022).*

JPH1040500A EPO Translation with Paragraph Numbers (Year: 1998).*

KR101938817B1 EPO Translation with Paragraph Numbers (Year: 2019).*

Pirsiavash, Ali et al. "GNSS Code Multipath Mitigation by Cascading Measurement Monitoring Techniques." Sensors (Basel, Switzerland) vol. 18,Jun. 1967. Jun. 19, 2018, doi:10.3390/s18061967 (Year: 2018).*

KR101938817B1 EPO Trasnlation with Paragraph Numbers (Year: 2019).*

KR20190101275A EPO Translation with Paragraph Numbers (Year: 2019).*

* cited by examiner

2

(a)

(b)

PORT MONITORING SYSTEM

CROSS REFERENCE TO RELATED APPLICATIONS

This application claims priority to Korean Patent Application Nos. 10-2023-0051054 filed on Apr. 19, 2023, 10-2023-0163453 filed on Nov. 22, 2023 and 10-2024-0000431 filed on Jan. 2, 2024, which are hereby incorporated by reference in their entirety.

BACKGROUND OF THE INVENTION

The present disclosure relates to a port monitoring system, and more specifically, to a monitoring system for ships and fenders on which sensors located within a port are mounted and which is capable of position monitoring.

A ship refers to a means of transportation that allows people, goods, etc. to move on or under water. Therefore, unlike land transportation, it is difficult for ships to move along a set route or stop at a specific position, and their position or posture may change due to the flow of water.

A fender (impact preventing material) is an instrument installed on the wall surface of the quay wall or the side of a ship in order to prevent damage to the hull and quay wall when berthing or approaching a ship in a port. For example, the fender is fixed to the wall surface of the quay wall or the side of the ship by a fixing member and is positioned so that the wall surface does not come into direct contact with the ship when berthing or approaching the ship, thereby preventing impact. If the fender deviates from its proper position, the wall surface may come into direct contact with the ship when berthing or approaching a ship, which may result in damage to the hull and quay wall. Additionally, if the fender is not always maintained at appropriate air pressure, its impact prevention effect may decrease or it may be damaged due to excessive pressure.

Accordingly, it is important to monitor the accurate position and posture of ships, especially large ships, in a port (or harbor), and it is important to monitor the position and status of fenders in the port. In particular, a system for integrally managing ships and fenders to efficiently manage ports is needed, and a system that can check the status of ships and fenders in possible real time is needed.

SUMMARY OF THE INVENTION

An object of the present disclosure is to provide a port management system that can integrally manage ships and fenders located in a port.

The other object of the present disclosure is to provide a method capable of monitoring the positions of the ships and the positions of the fenders in real time.

The present disclosure provides a port monitoring system including: a port environment detection unit that measures environmental conditions of a port to generate port environment information; a ship monitoring unit included in a ship to generate ship information of the ship; a fender monitoring unit included in a fender to generate fender information of the fender; a network; and a port management unit, wherein the port management unit receives the port environment information generated by the port environment detection unit, the ship information generated by the ship monitoring unit, and the fender information generated by the fender monitoring unit through the network to monitor the ship and the fender.

According to one embodiment of the present disclosure, the status of ships and fenders located in a port can be comprehensively checked in real time.

Further, according to one embodiment of the present disclosure, the position and movement of the ships and fenders located in a port can be accurately and easily grasped.

Further, according to one embodiment of the present disclosure, the history of the ships and fenders located in a port can be easily grasped.

Further, according to one embodiment of the present disclosure, whether there are any abnormalities in the ships and fenders located in a port or not can be easily grasped.

DETAILED DESCRIPTION OF THE INVENTION

Hereinafter, embodiments of the present disclosure are described in detail. However, the present disclosure is not limited to the embodiments disclosed below, but may be implemented in various different forms. The present embodiments are only provided to ensure that the disclosure of the present disclosure is complete and to more completely inform those skilled in the art of the content of the present disclosure.

In the present specification, the terms 'upper' or 'lower' are relative concepts established from the observer's point of view, and if the observer's point of view changes, 'upper' may mean 'lower', and 'lower' may mean 'upper'.

The position measurement values of the sensor mentioned in the present specification are basically three-dimensional (x, y, z) measurement values, but for convenience of description of the invention, they are explained by being reduced to two-dimensional (x, y) components.

In the present specification, the deflection of a ship refers to a change in the turning direction of a ship and, for example, may refer to the angle formed by a line connecting the bow and the stern with the baseline.

Hereinafter, the present disclosure will be described in detail below with reference to the drawings.

Figure 1:
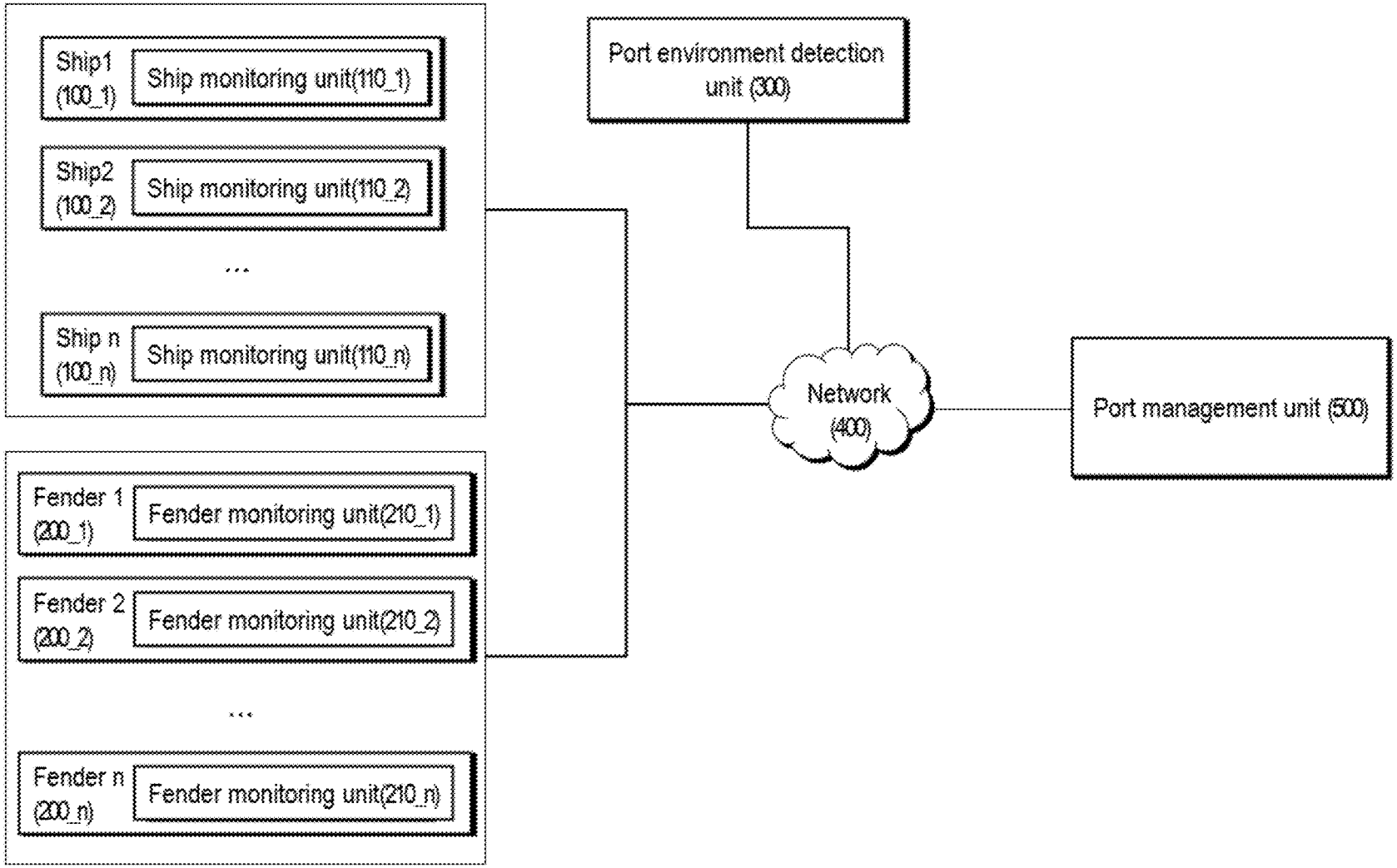
FIG. 1 is a configuration diagram of a port monitoring system according to one embodiment of the present disclosure.

FIG. 1 is a configuration diagram of a port monitoring system according to one embodiment of the present disclosure.

Referring to FIG. 1, the port monitoring system 1 may include a ship 100, a fender 200, a port environment detection unit 300, a network 400, and a port management unit 500.

The ship 100 may be a ship located near a port, and may be one or more ships 100 on which a ship monitoring unit 110 is installed. At this time, the ship 100 refers to a means capable of moving on the sea. For example, Ship 1 (100_1) may be a container ship on which a ship monitoring unit (110_1) is installed, and Ship 2 (100_2) may be a cruise ship on which a ship monitoring unit (110_2) is installed, but is not limited thereto.

The ship 100 may include a ship monitoring unit 110. For example, the ship monitoring unit 110 may measure and generate ship information related to the ship 100, such as the position of the ship 100, and transmit it to the port management unit 500.

The fender 200 may be an impact preventing material or a rubbing strip located near a port, and may be one or more fenders 200 on which a fender monitoring unit 210 is installed. At this time, the fender 200 may be installed on the ship 100 and the port structure existing in the port. For example, Fender 1 (200_1) may be a pneumatic impact preventing material on which a fender monitoring unit (210_1) installed on the wall surface of the pier where the ship berths is installed, and Fender 2 (200_2) may be a pneumatic impact preventing material on which a fender monitoring unit (210_2) installed on the port pier is installed, but is not limited thereto.

The fender monitoring unit 210 installed on the fender 200 may measure and generate fender information related to the fender 200, such as the position of the fender 200 and the fender pressure, and transmit it to the port management unit 500.

The port environment detection unit 300 may measure the surrounding environmental conditions of the port to generate port environment information. For example, port environmental information may be generated by measuring port temperature, wind speed, and wind direction, and transmitted to the port management unit 500.

The port management unit 500 may receive the port environment information generated by the port environment detection unit 300, the ship information generated by the ship monitoring unit 110, and the fender information generated by the fender monitoring unit 210 through the network 400.

The network 400 means a communication system in which the ship monitoring unit 110, the fender monitoring unit 210, and the port environment detection unit 300 are connected to the port management unit 500 so that information may be transmitted and received. At this time, the network 400 may have wired communication technology or wireless communication technology applied thereto. For example, the network 400 may have wired communication technologies such as Ethernet, xDSL(ADSL, VDSL), hybrid fiber coaxial cable (HFC), and fiber to the curb (FTTC) applied thereto, may have low-power long-distance communication technology applied thereto, and may have wireless communication technologies using LoRa, LoRaWAN, and RF applied thereto, but is not limited thereto, and may include all other forms of wired communication technology and wireless communication technology that are well known or will be developed in the future.

Accordingly, the port management unit 500 may integrally manage and monitor the ship 100 located near the port, the fender 200 located near the port, and the port environment.

Figure 2:
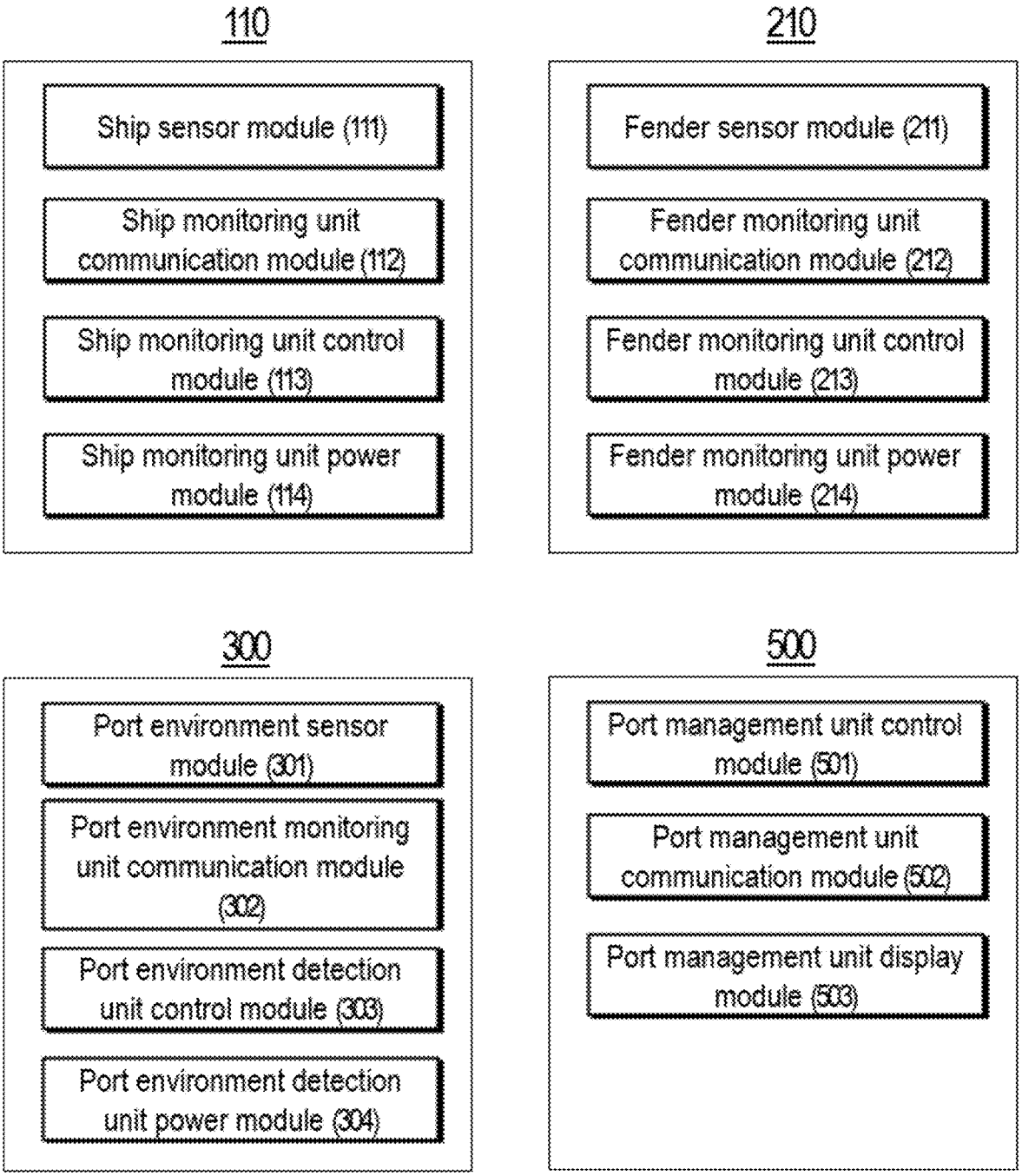
FIG. 2 is a configuration diagram of a ship monitoring unit, a fender monitoring unit, a port environment detection unit, and a port management unit according to one embodiment of the present disclosure.

FIG. 2 is a configuration diagram of a ship monitoring unit, a fender monitoring unit, a port environment detection unit, and a port management unit according to one embodiment of the present disclosure.

The ship monitoring unit 110 may include a ship sensor module 111, a ship monitoring unit communication module 112, a ship monitoring unit control module 113, and a ship monitoring unit power module 114.

The ship sensor module 111 may include various sensors for monitoring the ship. For example, it may include a ship position measuring sensor (e.g., GPS), a temperature and humidity sensor, a pressure sensor, a tilt sensor, and an acceleration sensor, but is not limited thereto, and may include one or more of the same sensors, but is not limited thereto. Accordingly, the ship monitoring unit 110 may generate ship information related to the ship's position, movement, and environment around the ship through the ship sensor module 111.

The ship monitoring unit communication module 112 may support the establishment of a wireless communication channel with an external electronic device or the port management unit 500 through the network (400 in FIG. 1) described above in FIG. 1, and the performance of communication through the established communication channel.

The ship monitoring unit communication module 112 may include one or more communication processors that support wireless communication. For example, the ship monitoring unit communication module 112 may include a communication processor capable of performing LoRa, LoRaWAN, and RF communication, but is not limited thereto.

The ship monitoring unit control module 113 may control other components of the ship monitoring unit 110 (e.g., a ship sensor module 111, a ship monitoring unit communication module 112, a ship monitoring unit power module 114, etc.). For example, the ship monitoring unit control module 113 may control the operation of other components of the ship monitoring unit 110. In addition, for example, the ship monitoring unit control module 113 may load commands or data received from other components (e.g., the ship sensor module 111, the ship monitoring unit communication module 112, the ship monitoring power module 114, etc.), as at least a portion of the processing or calculation of various data, into a volatile memory, process commands or data stored in the volatile memory, and store the resulting data in a non-volatile memory.

The ship monitoring unit control module 113 may include a main processor (e.g., central processing unit or application processor) and an auxiliary processor (e.g., graphic processing unit or communication processor) that can operate independently therefrom or together therewith, but is not limited thereto.

The ship monitoring unit power module 114 may supply power to components of the ship monitoring unit 110. For example, the ship monitoring unit power module 114 may receive power flowing from the outside and supply power to the components of the ship monitoring unit 110, and may supply power to the components of the ship monitoring unit 110 by including a primary battery, a secondary battery, etc.

The fender monitoring unit 210 may include a fender sensor module 211, a fender monitoring unit communication module 212, a fender monitoring unit control module 213, and a fender monitoring unit power module 214.

The fender sensor module 211 may include various sensors for monitoring the fender. For example, it may include a fender position measuring sensor (e.g., GPS), a temperature and humidity sensor, a pressure sensor, a tilt sensor, and an acceleration sensor, but is not limited thereto. Accordingly, the fender monitoring unit 210 may generate fender information related to the fender's position, movement, pressure, temperature, and environment around the fender through the fender sensor module 211.

The fender monitoring unit communication module 212 may support the establishment of a wireless communication channel with an external electronic device or the port management unit 500 through the network (400 in FIG. 1) described above in FIG. 1, and the performance of communication through the established communication channel.

The fender monitoring unit communication module 212 may include one or more communication processors that support wireless communication. For example, the fender monitoring unit communication module 212 may include a communication processor capable of performing LoRa, LoRaWAN, and RF communication, but is not limited thereto.

The fender monitoring unit control module 213 may control other components of the fender monitoring unit 210 (e.g., the fender sensor module 211, the fender monitoring unit communication module 212, the fender monitoring unit power module 214, etc.). For example, the fender monitoring unit control module 213 may control the operation of other components of the fender monitoring unit 210. In addition, for example, the fender monitoring unit control module 213 may load commands or data received from other components (e.g., the fender sensor module 211, the fender monitoring unit communication module 212, the fender monitoring unit power module 214, etc.), as at least a portion of the processing or calculation of various data, into a volatile memory, process commands or data stored in the volatile memory, and store the resulting data in a non-volatile memory.

The fender monitoring unit control module 213 may include a main processor (e.g., central processing unit or application processor) and an auxiliary processor (e.g., graphic processing unit or communication processor) that can operate independently therefrom or together therewith, but is not limited thereto.

The fender monitoring unit power module 214 may supply power to components of the fender monitoring unit 210. For example, the fender monitoring unit power module 214 may receive power flowing from the outside and supply power to the components of the fender monitoring unit 210, and may supply power to the components of the fender monitoring unit 210 by including a primary battery, a secondary battery, etc.

The port environment detection unit 300 may include a port environment sensor module 301, a port environment monitoring unit communication module 302, a port environment detection unit control module 303, and a port environment detection unit power module 304.

The port environment sensor module 301 may include various sensors for monitoring the port environment. For example, it may include a temperature and humidity sensor, a pressure sensor, a wind direction sensor, and a wind speed sensor, but is not limited thereto. Accordingly, the port environment detection unit 300 may measure temperature, humidity, pressure (barometric pressure), wind direction, and wind speed that are the port environmental conditions through the port environment sensor module 301 to generate port environment information.

The port environment monitoring unit communication module 302 may support the establishment of a wired or wireless communication channel with an external electronic device or the port management unit 500 through the network (400 in FIG. 1) described above in FIG. 1, and the performance of communication through the established communication channel.

The port environment monitoring unit communication module 302 may include one or more communication processors supporting wired or wireless communication. For example, it may include a communication processor capable of performing wired communication technologies such as Ethernet, xDSL(ADSL, VDSL), hybrid fiber coaxial cable (HFC), fiber to the curb (FTTC), etc., and may include a communication processor capable of performing low-power long-distance communication technology, and wireless communication technologies using LoRa, LoRaWAN, and RF, but is not limited thereto.

The port environment detection unit control module 303 may control other components of the port environment detection unit 300 (e.g., a port environment sensor module 301, a port environment monitoring unit communication module 302, a port environment detection unit power module 304, etc.). For example, the port environment detection unit control module 303 may control the operation of other components of the port environment detection unit 300. In addition, for example, the port environment detection unit control module 303 may load commands or data received from other components (e.g., the port environment sensor module 301, the port environment monitoring unit communication module 302, the port environment detection unit power module 304, etc.), as at least a portion of the processing or calculation of various data, into a volatile memory, process commands or data stored in the volatile memory, and store the resulting data in a non-volatile memory.

The port environment detection unit control module 303 may include a main processor (e.g., central processing unit or application processor) and an auxiliary processor (e.g., graphic processing unit or communication processor) that can operate independently therefrom or together therewith, but is not limited thereto.

The port environment detection unit control module 303 may supply power to components of the port environment detection unit 300. For example, the port environment detection unit control module 303 may receive power flowing from the outside and supply power to the components of the port environment detection unit 300, and may supply power to the components of the port environment detection unit 300 by including a primary battery, a secondary battery, etc.

The port management unit 500 may include a port management unit control module 501, a port management unit communication module 502, and a port management unit display module 503.

The port management unit control module 501 may control other components of the port management unit 500 (e.g., a port management unit communication module 502, a port management unit display module 503, etc.). For example, the port management unit control module 501 may control the operation of other components of the port management unit 500. In addition, for example, the port management unit control module 501 may load at least a portion of the processing or calculation of various data, for example, information received from the ship monitoring unit 110, the fender monitoring unit 210, the port environment detection unit 300, etc. and information and commands input through various input devices (e.g., keyboard, mouse, touch screen, voice recognition device, etc.) included in the port management unit 500 into a volatile memory, process information or commands stored in the volatile memory, and store data based on the processing results in a non-volatile memory.

The port management unit control module 501 may include a main processor (e.g., central processing unit or application processor) and an auxiliary processor (e.g., graphic processing unit or communication processor) that can operate independently therefrom or together therewith, but is not limited thereto.

The port management unit communication module 502 may support the establishment of a wired or wireless communication channel with an external electronic device or the ship monitoring unit 110, the fender monitoring unit 210, and the port environment detection unit 300 through the network (400 in FIG. 1) described above in FIG. 1, and the performance of communication through the established communication channel.

The port management unit communication module 502 may include one or more communication processors supporting wired or wireless communication. For example, it may include a communication processor capable of performing wired communication technologies such as Ethernet, xDSL(ADSL, VDSL), hybrid fiber coaxial cable (HFC), fiber to the curb (FTTC), etc., and may include a communication processor capable of performing low-power long-distance communication technology, and wireless communication technologies using LoRa, LoRaWAN, and RF, but is not limited thereto.

The port management unit display module 503 may visually provide information to the outside (e.g., manager). For example, it may include various types of displays such as a liquid crystal display (LCD), an ultra-thin liquid crystal display (TFT-LCD, thin film transistor LCD), a light emitting diode (LED), an organic light emitting diode (OLED, organic LED), an active matrix organic light emitting diode (AMOLED, Active Matrix OLED), a retina display, a flexible display, a three-dimensional display, and a projector, and may include a control circuit for controlling the displays.

Further, the port management unit display module 503 may display information on a series of operation states and operation results that occur while the port management unit 500 performs its functions. In addition, the port management unit display module 503 may display a graphical user interface (GUI) for user convenience of the port management unit 500, user data input by the user, etc.

Accordingly, the port management unit 500 may display environmental conditions of the ship, fender, and port on the display through the display module 503 to effectively provide the environmental conditions of the ship, fender, and port to the user. Specific examples thereof will be described in detail through FIGS. 3 to 6.

FIGS. 3 to 6 show examples of display indications of the port management unit.

Figure 3:
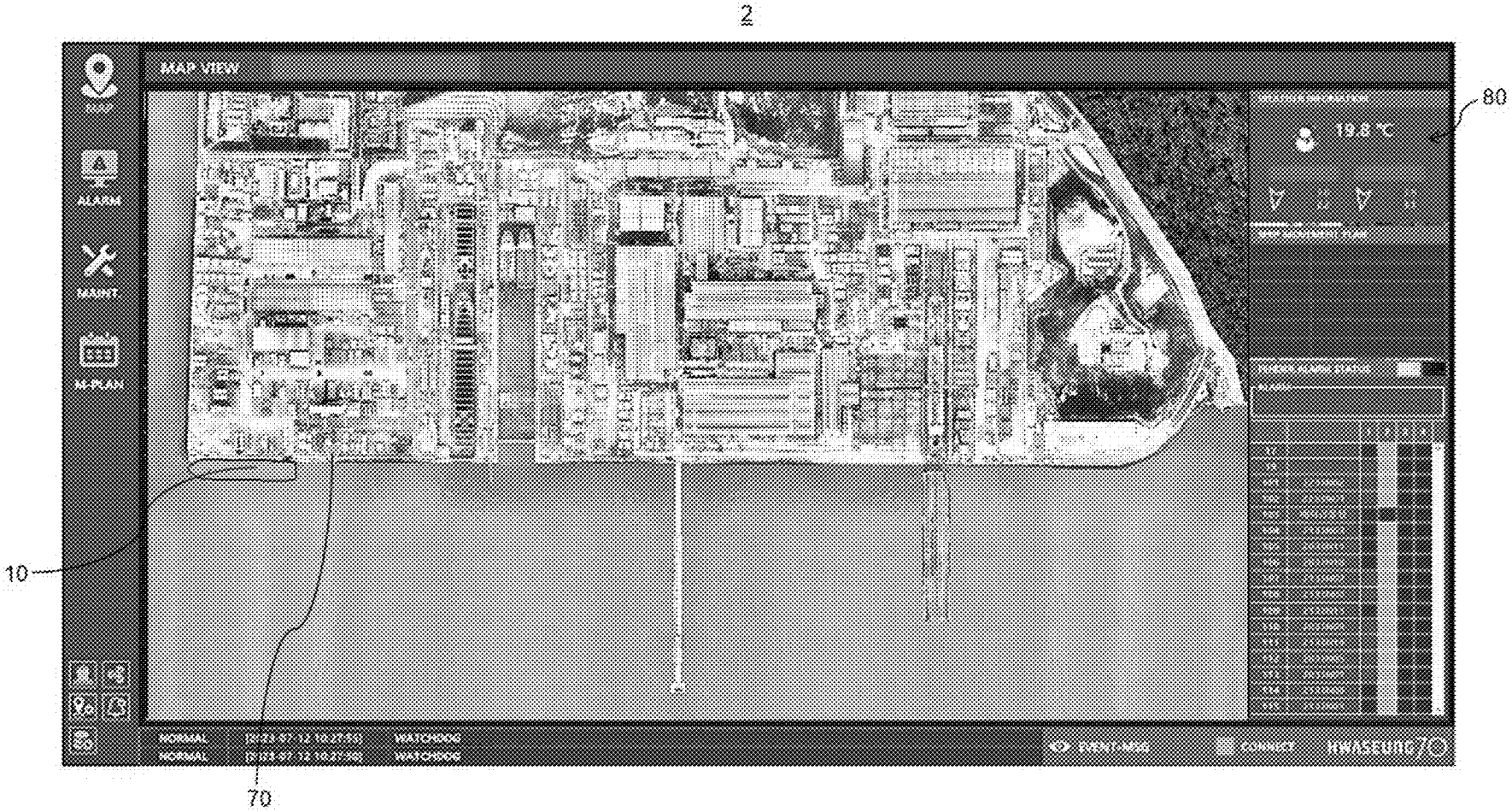
FIGS. 3 to 6 show examples of display indications of the port management unit.

Referring to FIG. 3, a port management screen 2 may be displayed on the display of the port management unit.

The port management screen 2 may display a port map, a ship indication 10, a fender indication 70, and a port environment indication 80 on the display. For example, the port management screen 2 may receive the port environment information generated by the port environment detection unit (300 in FIG. 1) from the port management unit (500 in FIG. 1) through the network (400 in FIG. 1) to display information on temperature, humidity, wind direction, and wind speed, which are environmental conditions of the port by the display module (503 in FIG. 2) of the port management unit (500 in FIG. 1) on the display. Accordingly, the manager may easily understand the surrounding environmental conditions of the port.

In addition, for example, the port management screen 2 may receive ship information generated by the ship monitoring unit (110 in FIG. 1) from the port management unit (500 in FIG. 1) through the network (400 in FIG. 1) to display the ship indication 10 by the display module (503 in FIG. 2) of the port management unit (500 in FIG. 1) on the display. At this time, the ship indication 10 may be displayed in a relative size so that the ship indication 10 is proportional to the actual size on the port map based on the scale and coordinates of the map based on the ship position measurement values among the ship information. Accordingly, the manager may effectively check the ship located in the port and accurately and easily grasp the position and movement of the ship.

In addition, for example, the port management screen 2 may receive fender information generated by the fender monitoring unit (210 in FIG. 1) from the port management unit (500 in FIG. 1) through the network (400 in FIG. 1) to display the fender indication 70 by the display module (503 in FIG. 2) of the port management unit (500 in FIG. 1) on the display. At this time, a fender indication 70 that displays the position in the form of an inverted triangle may be displayed on the port map based on the fender position measurement values among the fender information so that the manager can easily recognize the fender indication 70 based on the scale and coordinates of the map. Accordingly, the manager may effectively check the fender located in the port and accurately and easily grasp the position and movement of the fender.

Figure 4:
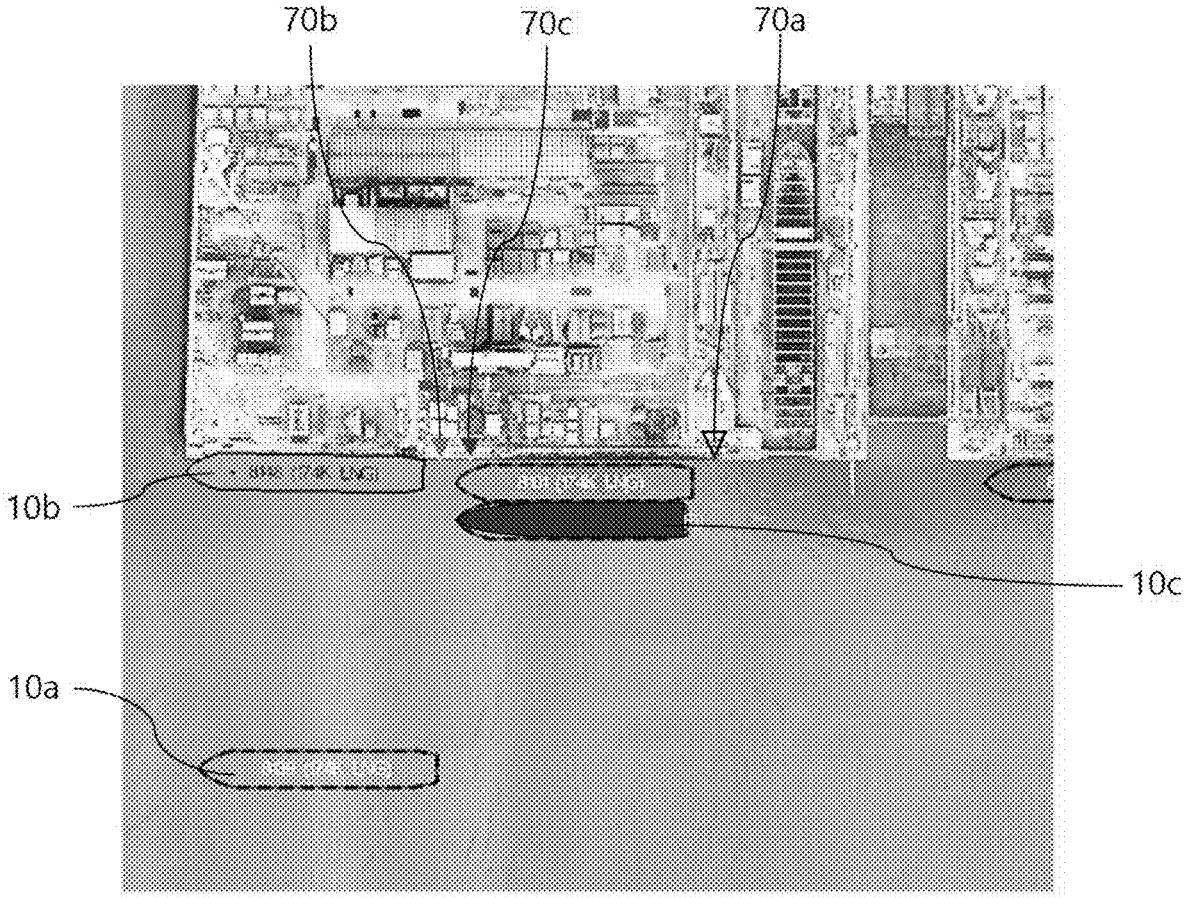

Referring to FIG. 4, the ship indication and fender indication on the port management screen may be displayed in various ways so that the manager may easily recognize them.

The ship indications 10*a*, 10*b*, and 10*c* are displayed on the port management screen for ships managed by the port management unit, and the ship names may be displayed in letters on the ship indications 10*a*, 10*b*, and 10*c*. Additionally, the ship indications 10*a*, 10*b*, and 10*c* may be displayed on the port management screen in forms that simulate the shapes of actual ships based on basic information on the ships input to the port management unit.

Figure 5:
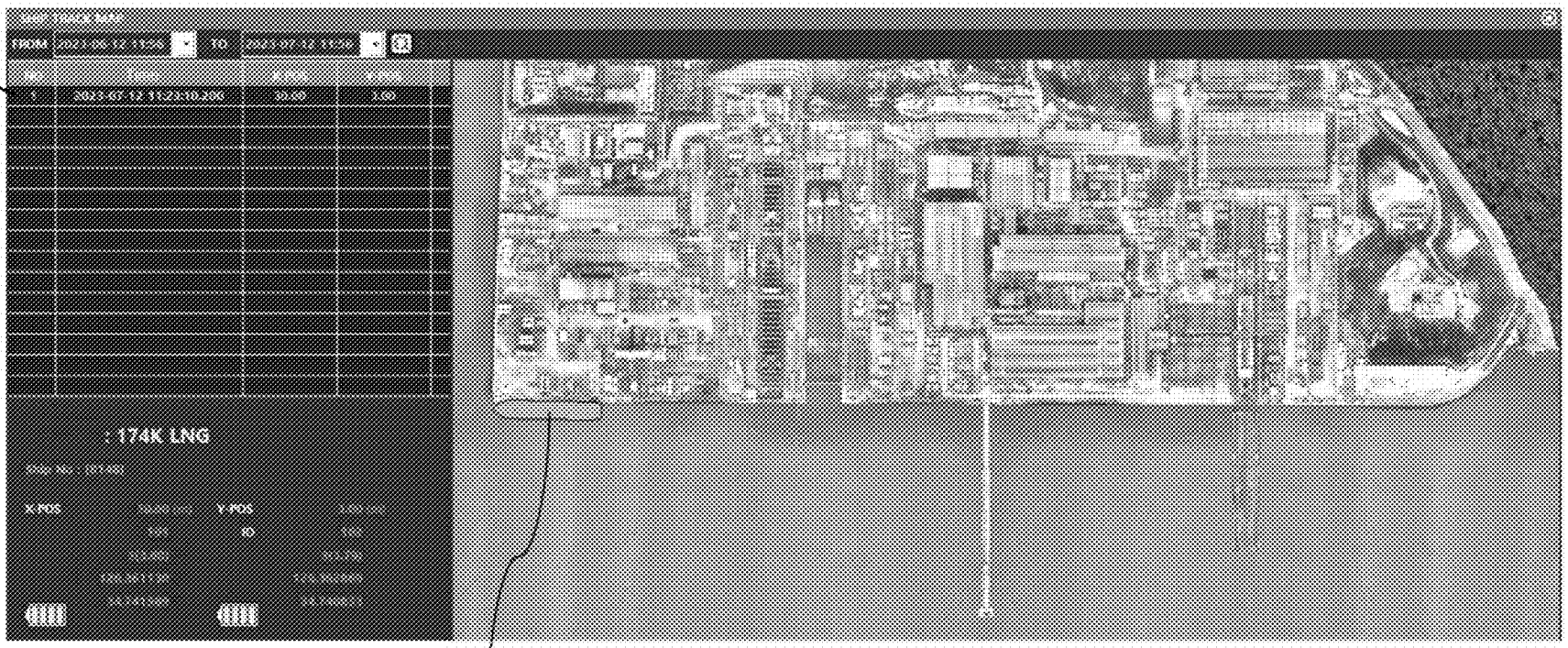

The port management screen may disclose information on the ships corresponding to the ship indications 10*a*, 10*b*, and 10*c* in a separate pop-up screen when the manager selects the ship indications 10*a*, 10*b*, and 10*c* so that various meta information on actual ships in conjunction with the ship indications 10*a*, 10*b*, and 10*c* may be checked. For example, when the manager selects the ship indication (10 in FIG. 5) as shown in FIG. 5, information on the actual ship corresponding to the ship indication (10 in FIG. 5) may be disclosed in a separate window on the left side of the port management screen. Accordingly, the manager may easily check and modify information on the actual ship through the port management screen. In addition, although it is not shown in FIG. 5, the history of the actual ship may be checked through the port management screen based on information collected through the actual ship in a method similar to the fender history disclosed in FIG. 6 described later. For example, ship movement lines and ship movement history points may be checked.

The ship indications 10*a*, 10*b*, and 10*c* may be displayed by classifying them into colors on the port management screen of the port management unit according to setting of whether or not the ships are managed by the port management unit. For example, in the case of a ship registered with the port management unit but not subject to management, as the port management unit selects the management subject setting as not setting, only the contour of the ship may be displayed as shown in the ship indication 10*a* and the inside of the contour line may be displayed to be transparent. Accordingly, it may be possible to lower the concentration of the manager's gaze on the ship indication 10*a* that is not subject to management, thereby helping to focus on the ships that have to be managed.

In addition, in the case of a ship registered with the port management unit but subject to management, as the port management unit selects the management subject setting as setting, the contour of the ship and the inside of the contour line may be filled with colors as shown in the ship indications 10*b* and 10*c*. Accordingly, it may be possible to increase the concentration of the manager's gaze on the ship indications 10*b* and 10*c* that are subject to management, thereby helping to focus on the ships that have to be managed.

In addition, the ship indications 10*b* and 10*c* of ships registered with the port management unit but subject to management may be displayed by classifying them into colors according to the states of the ships. For example, if the ship is normal in terms of the management standards designated by the port management unit (e.g., ship position, tilt, etc.), it is displayed in green as shown in the ship indication 10*b*, allowing the user to easily check that there is not an abnormality with the relevant ship through the port management screen. In addition, if the ship has an abnormality in accordance with the management standards designated by the port management unit, it is displayed in red as shown in the ship indication 10*c*, so that the user may easily check that there is an abnormality with the relevant ship through the port management screen. Accordingly, it may help the manager easily grasp the status of the ship indications 10*b* and 10*c* subject to management.

Fender indications 70*a*, 70*b*, and 70*c* are displayed on the port management screen for the fenders managed by the port management unit, but since the actual sizes of the fenders in the fender indications 70*a*, 70*b*, and 70*c* are smaller than the size of the port, they may be displayed in a separate shape (for example, an inverted triangle shape) so that the manager may easily check the position through the port management screen.

Figure 6:
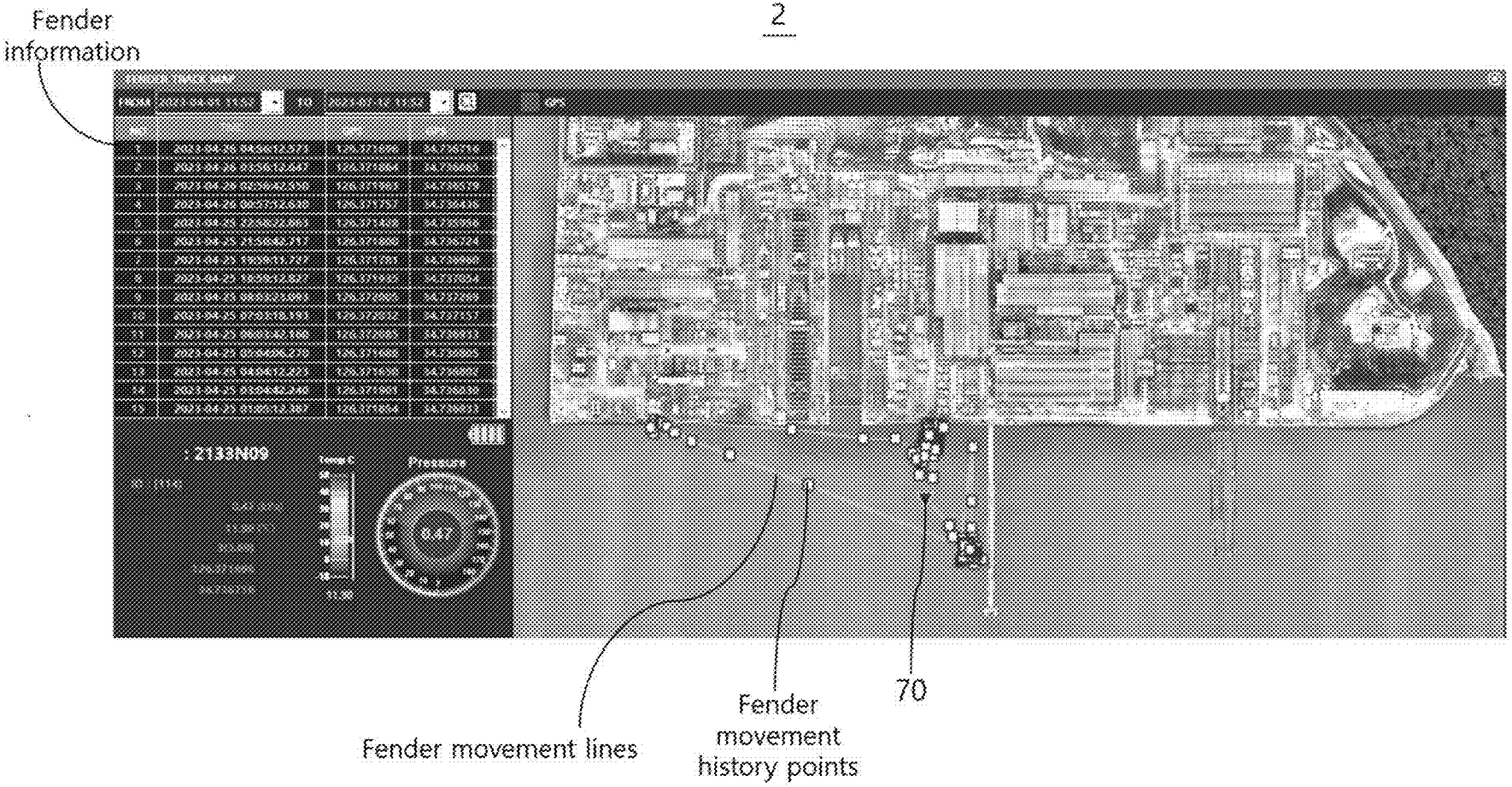

The port management screen may disclose information on the fenders corresponding to the fender indications 70*a*, 70*b*, and 70*c* in a separate pop-up screen when the manager selects the fender indications 70*a*, 70*b*, and 70*c* so that various meta information on actual fenders in conjunction with the fender indications 70*a*, 70*b*, and 70*c* may be checked. For example, when the manager selects the fender indication (70 in FIG. 6) as shown in FIG. 6, information on the actual fender corresponding to the fender indication (70 in FIG. 6) may be disclosed in a separate window on the left side of the port management screen. Accordingly, the manager may easily check and modify information on the actual fender through the port management screen. In addition, when the manager selects the fender indication (70 in FIG. 6) as shown in FIG. 6, the history of the actual fender may be checked through the port management screen based on information collected through the actual fender. For example, fender movement lines and fender movement history points may be checked.

The fender indications 70*a*, 70*b*, and 70*c* may be displayed by classifying them into colors on the port management screen of the port management unit according to setting of whether or not the fenders are managed by the port management unit. For example, in the case of a fender registered with the port management unit but not subject to management, as the port management unit selects the management subject setting as not setting, only the contour of an inverted triangle may be displayed as shown in the fender indication 70*a* and the inside of the contour line may be displayed to be transparent. Accordingly, it may be possible to lower the concentration of the manager's gaze on the fender indication 70*a* that is not subject to management, thereby helping to focus on the fenders that have to be managed.

In addition, in the case of a fender registered with the port management unit but subject to management, as the port management unit selects the management subject setting as setting, the contour of an inverted triangle and the inside of the contour line may be filled with colors as shown in the fender indications 70*b* and 70*c*. Accordingly, it may be possible to increase the concentration of the manager's gaze on the fender indications 70*b* and 70*c* that are subject to management, thereby helping to focus on the fenders that have to be managed.

In addition, the fender indications 70*b* and 70*c* of fenders registered with the port management unit but subject to management may be displayed by classifying them into colors according to the states of the fenders. For example, if the fender is normal in terms of the management standards designated by the port management unit (e.g., fender pressure, position, etc.), it is displayed in green as shown in the fender indication 70*b*, allowing the user to easily check that there is not an abnormality with the relevant fender through the port management screen. In addition, if the fender has an abnormality in accordance with the management standards designated by the port management unit, it is displayed in red as shown in the fender indication 70*c*, so that the user may easily check that there is an abnormality with the relevant fender through the port management screen. Accordingly, it may help the manager easily grasp the status of the fender indications 70*b* and 70*c* subject to management.

Figure 7:
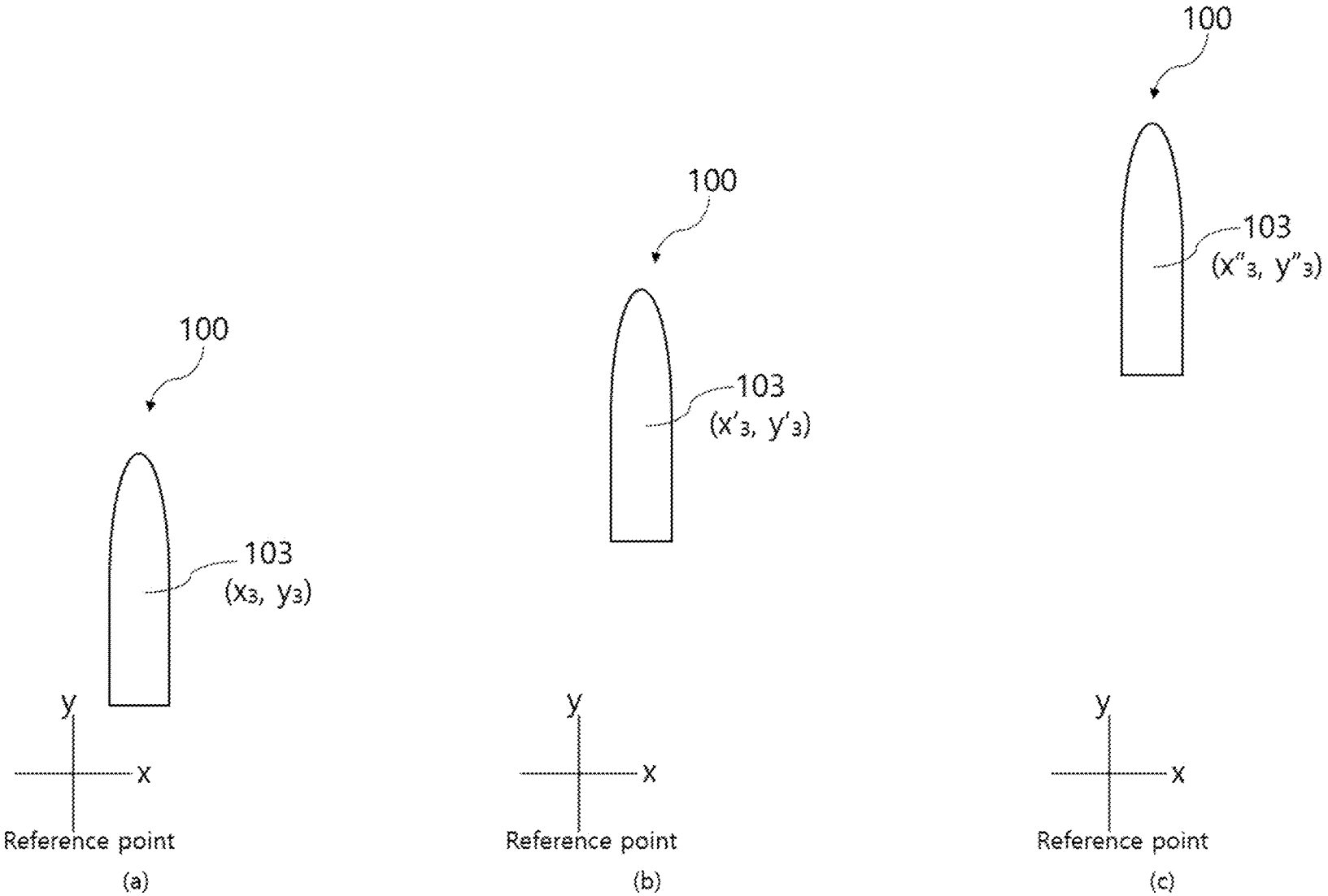
FIGS. 7 and 8 are mimetic diagrams showing the results of tracking changes in ship positions according to time changes.
Figure 8:
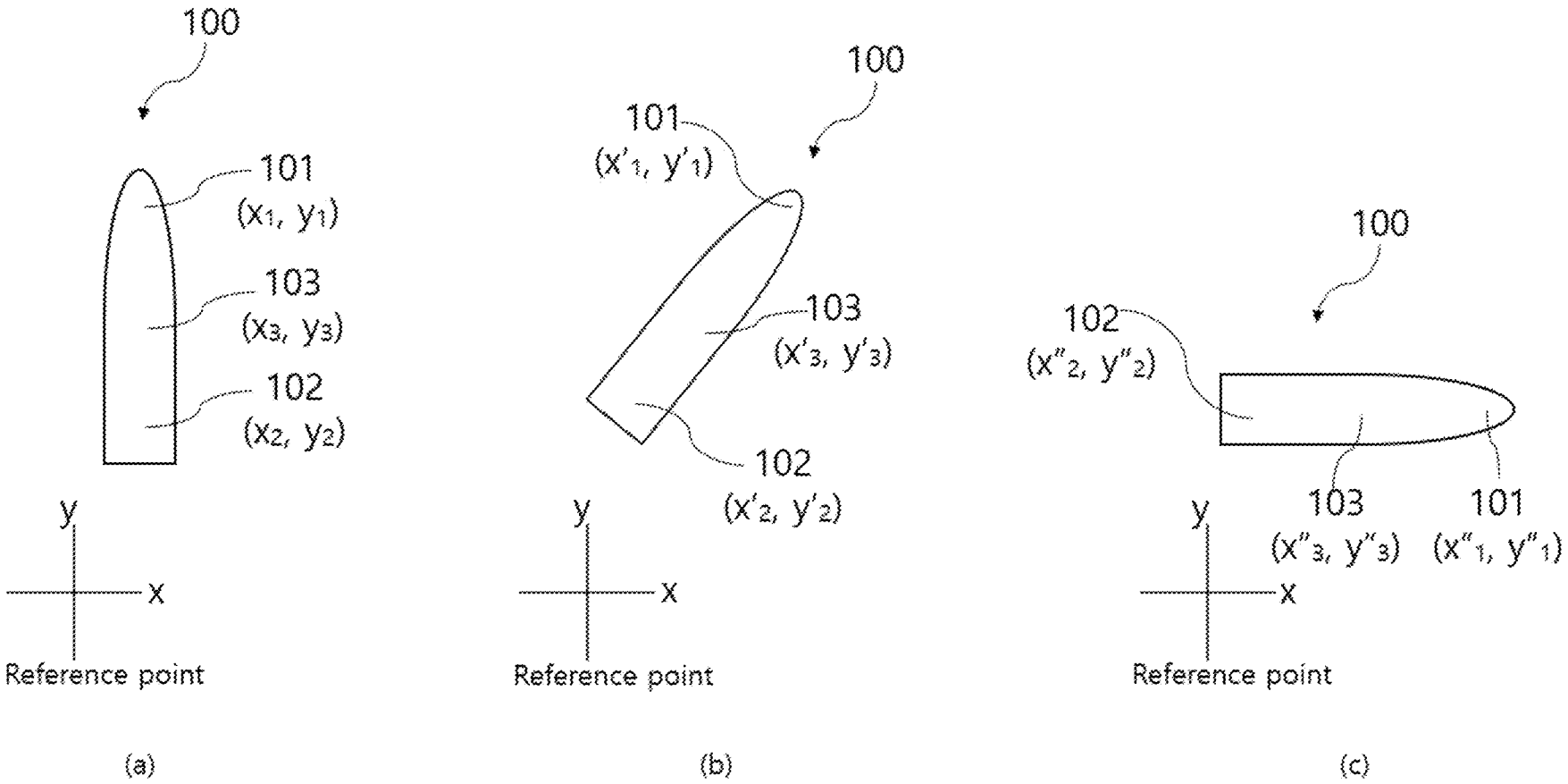

FIGS. 7 and 8 are mimetic diagrams showing the results of tracking changes in ship positions according to time changes.

FIG. 7 shows that a ship position measurement sensor capable of position measurement is mounted on the central part 103 ($x_3$, $y_3$) of the ship 100.

Referring to FIG. 7, the position of the ship 100 with respect to the reference point may change in the order of FIG. 7(A), FIG. 7(B), and FIG. 7(C) according to time sequence. Along with this, the position of the central part 103 ($x_3$, $y_3$) in FIG. 7(A) may be measured, and the position of the central part 103 ($x'_3$, $y'_3$) in FIG. 7(B) may be measured after a certain period of time has passed. After a certain period of time has passed since the position of the central part 103 ($x'_3$, $y'_3$) in FIG. 7(B) was measured, the position of the central part 103 ($x''_3$, $y''_3$) in FIG. 7(C) may be measured. Accordingly, the position of the ship 10 may be grasped based on the above positions and the actual length and width data of the ship, and the moving speed of the ship may be calculated based on the ship position changes and time. In this way, when the movement is estimated from one position measurement value of one point of the ship 100, for example, the bow part (101 in FIG. 8), the stern part (102 in FIG. 8), or the central part 103, it becomes difficult to monitor the ship's rotation. In particular, since the length of the ship 100 is long when the ship 100 is large, tracking the rotational movement together with the mooring direction of the ship 100 is very important.

However, in the past, only the mooring direction of the ship 100 could be checked or rotational movement could be tracked, but there was a problem in that a lot of expensive equipment had to be installed.

Accordingly, the inventors of the present disclosure provides a method which can correct the measurement values of the position sensor in a simple way even if expensive equipment is not applied, thereby reducing errors and deviations and stabilizing data dispersion, and which can effectively correct abnormal error values, thereby accurately measuring and monitoring the ship's position and ship's deflection.

FIG. 8 shows that a sensor capable of measuring position is mounted on the bow part 101 ($x_1$, $y_1$), the stern part 102 ($x_2$, $y_2$), and the central part 103 ($x_3$, $y_3$) of the ship 100.

Referring to FIG. 8, the position of the ship 100 with respect to the reference point may change in the order of FIG. 8(A), FIG. 8(B), and FIG. 8(C) according to time sequence. Along with this, the positions of the bow part 101 ($x_1$, $y_1$), the stern part 102 ($x_2$, $y_2$), and the central part 103 ($x_3$, $y_3$) in FIG. 8(A) may be measured, and the positions of the bow part 101 ($x'_1$, $y'_1$), the stern part 102 ($x'_2$, $y'_2$), and the central part 103 ($x'_3$, $y'_3$) in FIG. 8(B) may be measured after a certain period of time has passed. After a certain period of time has passed since the positions of the bow part 101 ($x'_1$, $y'_1$), the stern part 102 ($x'_2$, $y'_2$), and the central part 103 ($x'_3$, $y'_3$) in FIG. 8(B) were measured, the positions of the bow part 101 ($x''_1$, $y''_1$), the stern part 102 ($x''_2$, $y''_2$), and the central part 103 ($x''_3$, $y''_3$) in FIG. 8(C) may be measured. At this time, if the position values of the stern part 102 are measured equally, such as ($x_2$, $y_2$)=($x'_2$, $y'_2$)=($x''_2$, $y''_2$), according as it is measured that the coordinate values of the bow part 101 are changed from ($x_1$, $y_1$) to ($x'_1$, $y'_1$), and from ($x'_1$, $y'_1$) to ($x''_1$, $y''_1$), or it is measured that the coordinate values of the central part 103 are changed from ($x_3$, $y_3$) to ($x'_3$, $y'_3$), and from ($x'_3$, $y'_3$) to ($x''_3$, $y''_3$), the mooring direction of the ship 100 can be confirmed, and it can be confirmed that the ship 100 is rotating around the stern part 102 as an axis.

In order to accurately monitor the direction and position of the ship 100 in consideration of the complex movement of the ship 100 like this, at least two ship position sensors capable of measuring position should be mounted on the ship 100, and preferably, it is suitable for the sensor to be mounted on the bow part 101 and the stern part 102 of the ship 100 to monitor the rotation of the ship 100, that is, the deflection of the ship 100.

For example, assuming that the length of the ship 100 is 100 m and that the direction is changed by 5° based on the stern part 120, the moving distance of the bow part 101 is 2×100 m× sin (5°/2)=about 9 m, and the movement of the central part 103 is about 4 m. At this time, assuming that the measurement error radius of the sensor is 5 m, the sensor of the bow part 101 can confirm the movement of the bow part 101 with a meaningful measurement value, thereby monitoring the deflection of the ship 100. However, if the sensor is located in the central part 103 rather than the bow part 101 and the stern part 102, it may be difficult to monitor the deflection of the ship 100.

Figure 9:
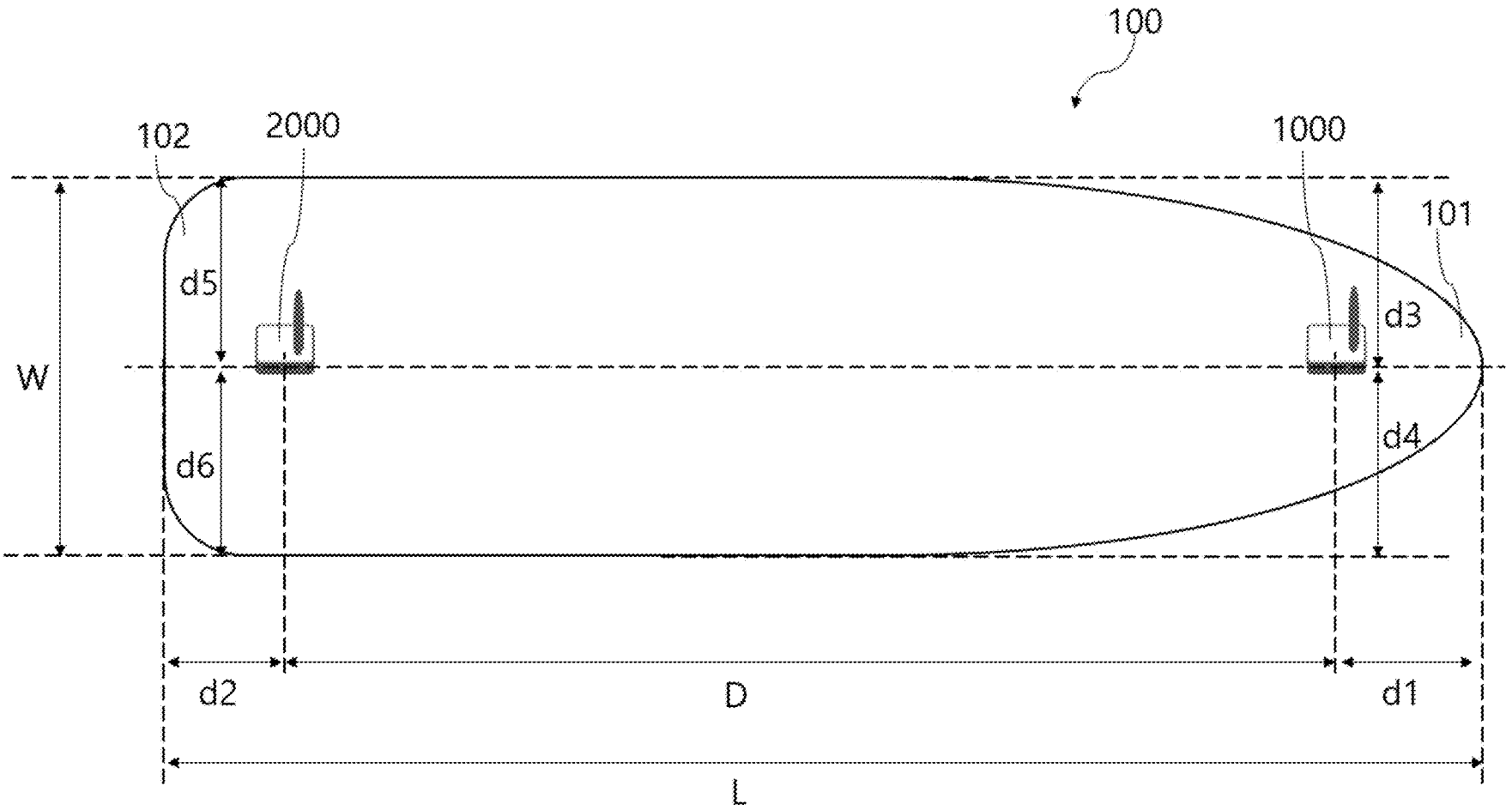
FIG. 9 is a mimetic diagram showing a ship position measurement sensor and a ship according to one embodiment of the present disclosure.

FIG. 9 is a mimetic diagram showing a ship position measurement sensor and a ship according to one embodiment of the present disclosure.

Referring to FIG. 9, a first sensor 1000, which is a ship position measurement sensor capable of position measurement at a portion of the bow part 101, and a second sensor 2000, which is a ship position measurement sensor capable of position measurement at a portion of the stern part 102, may be installed on a ship 100 capable of position monitoring.

In order to monitor the movement of the ship 100 as described in FIG. 8, the first sensor 1000 may be mounted on the portion of the bow part 101 of the ship 100, and the second sensor 2000 may be mounted on the portion of the stern part 102 of the ship 100. At this time, the first sensor 1000 and the second sensor 2000 may be mounted on the top of the ship so that they are prevented from being interfered with transmission and reception of wireless signals. For example, the first sensor 1000 and the second sensor 2000 may be mounted in an upper space open to the sky above the ship 100 so that the radio waves used for receiving and transmitting signals from the first sensor 1000 and the second sensor 2000 may spread into the sky.

For example, the first sensor 1000 and the second sensor 2000 may have a GPS sensor mounted thereon in order to measure the position, and may use low-power wide area communication, for example, LoRaWAN communication, in order to transmit the measured position measurement values. Additionally, in order to operate the first sensor 1000 and the second sensor 2000, power may be supplied from outside, or power may be supplied using a battery. At this time, it is possible that the battery may include a replaceable battery, a rechargeable battery, or a rechargeable and replaceable battery, but is not limited thereto.

The first sensor 1000 and the second sensor 2000 are mounted on the bow part 101 and the stern part 102 of the ship 100, respectively, and they may be mounted so that the distance D between the first sensor 1000 and the second sensor 2000 exceeds twice the maximum measurement error value of the first sensor 1000 or the second sensor 2000. For example, when it is based on the generally known maximum measurement error of GPS of 10 m, the distance D between the first sensor 1000 and the second sensor 2000 may be mounted to exceed 20 m. Accordingly, even if an error occurs in the position measurement values of the first sensor 1000 and the second sensor 2000, they may be separated into two meaningful points within the ship 100 and measured. In addition, in order to easily monitor the deflection of the ship 100, it is preferable that the first sensor 1000 is mounted on the bow part 101, and the second sensor 2000 is mounted on the stern part 102 so that the distance D between the first sensor 1000 and the second sensor 2000 has the maximum value within the ship 100.

The length (L) and width (W) of the ship 100 are already known measurement values, and the positions of the first sensor 1000 and the second sensor 2000 mounted within the ship 100 are also fixed values, and may be stored in advance in the database. Position measurement values including the position and deflection of the ship 100 may be accurately transmitted based on these length (L) and width (W) values and the position measurement values of the first sensor 1000 and the second sensor 2000.

For example, the separation distance d1 between the position of the first sensor 1000 and the end of the bow part 101 is corrected, and the separation distance d2 between the position of the second sensor 2000 and the end of the stern part 102 is corrected so that the corrected separation distances d1 and d2 may be converted into data at both end points corresponding to the length (L) of the ship 100 based on the measurement values measured by the first sensor 1000 and the second sensor 2000.

For example, the separation distances d3 and d4 between the first sensor 1000 and the side surface ends of the ship 100 are corrected, and the separation distances d5 and d6 between the second sensor 2000 and the side surface ends of the ship 100 are corrected so that the corrected separation distances d3, d4, d5, and d6 may be converted into data at both end points corresponding to the width (W) of the ship 100 based on the measurement values measured by the first sensor 1000 and the second sensor 2000.

When using the ship position measurement values generated from the ship position measurement sensor of the ship monitoring unit and the fender position measurement values generated from the fender position measurement sensor of the fender monitoring unit as they are, the errors and deviations of the ship position measurement values and the fender position measurement values are reflected as they are. For example, if large noises temporarily occur in the ship position measurement values, the relevant measurement values may be reflected as they are, interfering with port monitoring.

Accordingly, it is desirable to reduce errors and deviations and stabilize measurement value dispersion by correcting the ship position measurement values and the fender position measurement values after transmitting the ship position measurement values and the fender position measurement values to the port management unit (500 in FIG. 1), and apply the ship position measurement data and fender position measurement data to the port monitoring system by generating ship position measurement data and fender position measurement data in which values with abnormally large errors are corrected. At this time, as the correction method, a moving average method may be applied, and for example, at least one of the simple moving average, exponential moving average, weighted moving average, geometric moving average, and harmonic moving average methods may be applied.

Specifically, a continuous average value of measurement values, which is a type of exponential moving average, may be applied. For example, when it is the first measurement value ($x_1$, $y_1$), the second measurement value ($x_2$, $y_2$), the third measurement value ($x_3$, $y_3$), and the nth measurement value ($x_n$, $y_n$) measured from a position measurement sensor (where n is a natural number 1 or more, and the larger the value of n, the more recent the measurement value), the first position measurement data($D_{1x}$, $D_{1y}$) generated by the port management unit (500 in FIG. 1) is as follows.

$$D_{1x} = \frac{(x_1 + x_2)}{2},\ D_{1y} = \frac{(y_1 + y_2)}{2}$$

Afterwards, the second position measurement data($D_{2x}$, $D_{2y}$) generated by the port management unit (500 in FIG. 1) is as follows.

$$D_{2x} = \frac{\left(\frac{(x_1 + x_2)}{2} + x_3\right)}{2},\ D_{2y} = \frac{\left(\frac{(y_1 + y_2)}{2} + y_3\right)}{2}$$

This is written as follows:

$$D_{2x} = \left(\frac{x_1}{4} + \frac{x_2}{4} + \frac{x_3}{2}\right),\ D_{2y} = \left(\frac{x_1}{4} + \frac{x_2}{4} + \frac{x_3}{2}\right)$$

This is rewritten as follows:

$$D_{2x} = \frac{(D_{1x} + x_3)}{2},\ D_{2y} = \frac{(D_{1y} + y_3)}{2}$$

Afterwards, the nth position data($D_{nx}$, $D_{ny}$) generated by the port management unit (500 in FIG. 1) is as follows.

$$D_{nx} = \frac{(D_{(n-1)x} + x_{(n+1)})}{2},\ D_{ny} = \frac{(D_{(n-1)y} + y_{(n+1)})}{2}$$

This is written as follows:

$$D_{nx} = \left(\frac{x_1}{2^n} + \frac{x_2}{2^n} + \frac{x_3}{2^{(n-1)}} + \ldots + \frac{x_{(n+1)}}{2}\right),$$

$$D_{ny} = \left(\frac{y_1}{2^n} + \frac{y_2}{2^n} + \frac{y_3}{2^{(n-1)}} + \ldots + \frac{y_{(n+1)}}{2}\right),$$

Here, since the value of the denominator increases exponentially except for the last term, it may be assumed that there is little effect on the values of $D_{nx}$ and $D_{ny}$ For example, when the value of n is 5, the size of the denominator of the first two measurement values, $$\left(\frac{x_1}{2^5} + \frac{x_2}{2^5}\right) \text{ and } \left(\frac{y_1}{2^5} + \frac{y_2}{2^5}\right),$$

is 32, it can be seen that the effect on the values of $D_{5x}$ and $D_{5y}$ is greatly reduced. If this is expressed as a weight, the weight in the position data decreases in the order of about 50%, 25%, 13%, 6%, and 3%, starting from the latest measurement values.

Accordingly, high weight is given to the current measurement value and the measurement values close to the current measurement value, making it possible to position-monitor the position change trends of ships and fenders so that they are close to the current point, and when the trend of past measurement values is partially reflected so that excessive errors or deviations occur in the measurement values, they may be corrected.

This may be expressed as a general formula for the measurement values (x, y, z) as follows (n=a natural number of 1 or more, and the larger the value of n, the more recent the measurement value).

$$D_{nx} = \left(\frac{1}{2^n}\right)x_1 + \frac{1}{2}\sum_{i=0}^{n-1}\left(\frac{1}{2}\right)^i x_{(n-i+1)}$$

$$D_{ny} = \left(\frac{1}{2^n}\right)y_1 + \frac{1}{2}\sum_{i=0}^{n-1}\left(\frac{1}{2}\right)^i y_{(n-i+1)}$$

$$D_{nz} = \left(\frac{1}{2^n}\right)z_1 + \frac{1}{2}\sum_{i=0}^{n-1}\left(\frac{1}{2}\right)^i z_{(n-i+1)}$$

Further, a specific number of data, which is a type of simple moving average, may be selected to obtain the average, and the relevant value may be applied as position data. For example, if it is the first measurement value ($x_1$, $y_1$), the second measurement value ($x_2$, $y_2$), the third measurement value ($x_3$, $y_3$), and the nth measurement value ($x_n$, $y_n$) measured from a position measurement sensor (where n is a natural number of 1 or more, and the larger the value of n, the more recent the measurement value), when four values are selected sequentially to apply the arithmetic mean value, the first position data($D_{1x}$, $D_{1y}$) generated by the port management unit (500 in FIG. 1) is as follows.

$$D_{1x} = \frac{(x_1 + x_2 + x_3 + x_4)}{4}, D_{1y} = \frac{(y_1 + y_2 + y_3 + y_4)}{4}$$

Afterwards, the second position data($D_{2x}$, $D_{2y}$) generated by the port management unit (500 in FIG. 1) is as follows.

$$D_{2x} = \frac{(x_2 + x_3 + x_4 + x_5)}{4}, D_{2y} = \frac{(y_2 + y_3 + y_4 + y_5)}{4}$$

Afterwards, the nth position data($D_{nx}$, $D_{ny}$) generated by the port management unit (500 in FIG. 1) is as follows.

$$D_{nx} = \frac{(x_n + x_{n+1} + x_{n+2} + x_{n+3})}{4}, D_{ny} = \frac{(y_n + y_{n+1} + y_{n+2} + y_{n+3})}{4}$$

Accordingly, data near the latest measurement values may be used to stabilize data dispersion, and correct values in which errors abnormally occur.

However, when using such a method, there is a disadvantage in that if the data is composed of less than three data, the parameters of the position measurement values are reduced so that the effect of correcting values with large errors is weakened abnormally. For example, since the proportions of the measurement values are each 50% when using two measurement values, there is a disadvantage in that it is excessively reflected if one value is an abnormal value.

Since past values are excessively reflected if the data is composed of more than five data, there may be a disadvantage in that changes in the current position are immediately reflected. For example, since the proportions of measurement values are each 16.7% when using six data, there is a disadvantage in that the proportion of the latest measurement values is excessively lowered, making it difficult to reflect the latest trends.

The various moving average methods may be applied as described above and reduce errors and deviations in position measurement values measured from ship position measurement sensors or fender position measurement sensors, stabilize data dispersion, and correct values in which large errors abnormally occur, but the measurement values of the sensors may be corrected so that the position change trends of the ships and fenders are close to the current point, thereby applying the corrected measurement values of the sensors to the port monitoring system.

Figure 10:
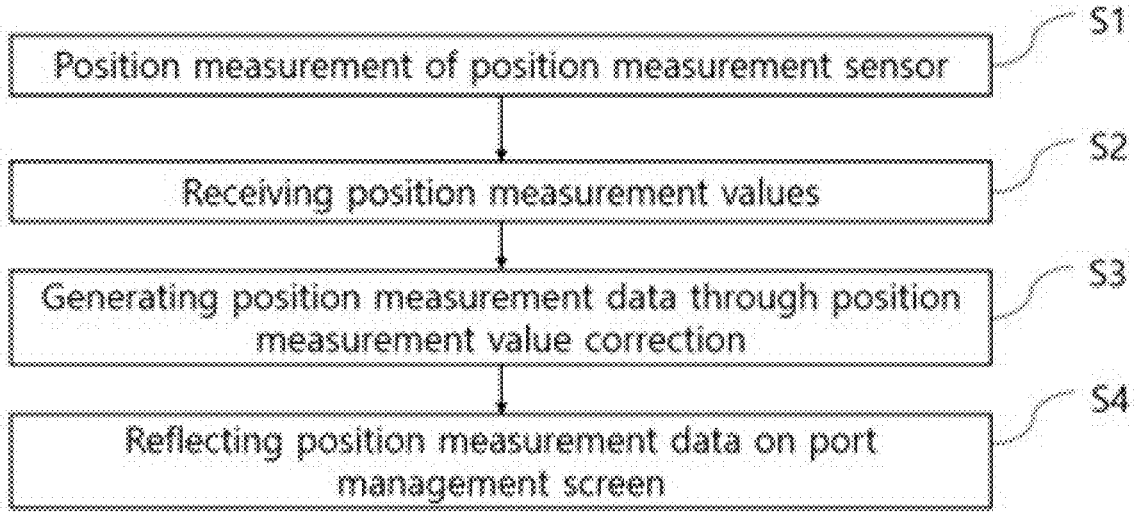
FIG. 10 is a flowchart of a method for monitoring ship and fender positions according to one embodiment of the present disclosure.

FIG. 10 is a flowchart of a method for monitoring ship and fender positions according to one embodiment of the present disclosure.

Referring to FIG. 10, the method for monitoring ship and fender positions in the port monitoring system is as follows.

The step S1 of position measurement of the position measurement sensor is a step of generating ship position measurement values by measuring the current position by one or more ship position measurement sensors included in the ship monitoring unit of the ship.

In addition, the step S1 of position measurement of the position measurement sensor is a step of generating fender position measurement values by measuring the current position by one or more fender position measurement sensors included in the fender monitoring unit of the fender.

At this time, position measurement of the ship position measurement sensor and the fender position measurement sensor is performed at regular intervals, and for example, position measurement values may be generated by receiving GPS signals.

When there is one or more position measurement sensors, and for example, the measurement timings of the first sensor and the second sensor are synchronized so that measurements may be made at the same time. In addition, the position measurement values measured by the first sensor and the second sensor are synchronized so that they may be transmitted at the same time. For example, if an A($x_{1-1}$, $y_{1-1}$) position measurement value is generated from the first sensor, and a B($x_{2-1}$, $y_{2-1}$) position measurement value is generated from the second sensor at a specific time T1, the two position measurement values may transmit the A($x_{1-1}$, $y_{1-1}$) position measurement value and the B($x_{2-1}$, $y_{2-1}$) position measurement value at the same time by including metadata for a specific time called T1. At this time, the first sensor and the second sensor may transmit the position measurement values using a wireless communication method. For example, a low-power wide area communication network may be used, but is not limited thereto.

The step S2 of receiving position measurement values is a step of receiving the ship position measurement values and the fender position measurement values from the port management unit. At this time, the port management unit sequentially stores the received position measurement values in the database. For example, the position measurement values may be stored in a database after being received by a separately provided control unit, or may be stored directly in the database.

For example, they may be stored in the time sequence such as $$T1: A_1(x_{1-1}, y_{1-1}), B_1(x_{2-1}, y_{2-1}),$$

$$T2: A_2(x_{1-2}, y_{1-2}), B_2(x_{2-2}, y_{2-2}), \text{ and}$$

$$T3: A_3(x_{1-3}, y_{1-3}), B_3(x_{2-3}, y_{2-3}).$$

The step S3 of generating position measurement data through position measurement value correction is a step of correcting the measurement values based on the most recent measurement value among the ship position measurement values stored in the database to generate ship position measurement data, and correcting the measurement values based on the most recent measurement value among the fender position measurement values to generate fender position measurement data. For example, if the $A_3$ and $B_3$ position measurement values are the latest measurement values, the measurement values are corrected based on the $A_3$ and $B_3$ position measurement values to generate position data $D_{A1}$ and $D_{B1}$. Afterwards, if the $A_4$ and $B_4$ position measurement values are generated, the measurement values are corrected based on the $A_4$ and $B_4$ position measurement values to generate position data $D_{A2}$ and $D_{B2}$. At this time, as the position measurement value correction method, the moving average method, for example, at least one of the simple moving average, exponential moving average, weighted moving average, geometric moving average, and harmonic moving average methods may be applied. The ship position measurement data and the fender position measurement data are stored in the database.

The step (S4) of reflecting the position measurement data on the port management screen is a step of linking the recent values of the ship position measurement data and the fender position measurement data stored in the database with a map and coordinates of the map which are displayed by the port management unit on the port management screen, linking them with length and width data, performing conversion, and then displaying the ship indications on the screen in the case of ships, and displaying the positions of the fenders as fender indications in the case of fenders.

At this time, the latest values are applied to the position measurement data to continuously update and display the ship indications and the fender indications on the port management screen. For example, if the position data $D_{A2}$ and $D_{B2}$ are generated after the ship indications are displayed on the screen using the position data $D_{A1}$ and $D_{B1}$, the ship indications are displayed on the screen by reflecting the position data $D_{A2}$ and $D_{B2}$.

Such a process may be repeated continuously by linking the steps of generating and transmitting new position measurement values in the step S1 of position measurement of the position measurement sensor, storing the new position measurement values in the database in the step S2 of receiving position measurement values, correcting the measurement values based on the new position measurement values and generating new position measurement data in the step S3 of generating position measurement data through position measurement value correction, and then updating, reflecting, and displaying the ship indications and fender indications with new position measurement data on the screen in the step (S4) of reflecting the position measurement data on the port management screen. Accordingly, the positions and deflections of the ships and fenders may be continuously monitored in real time.

Figure 11:
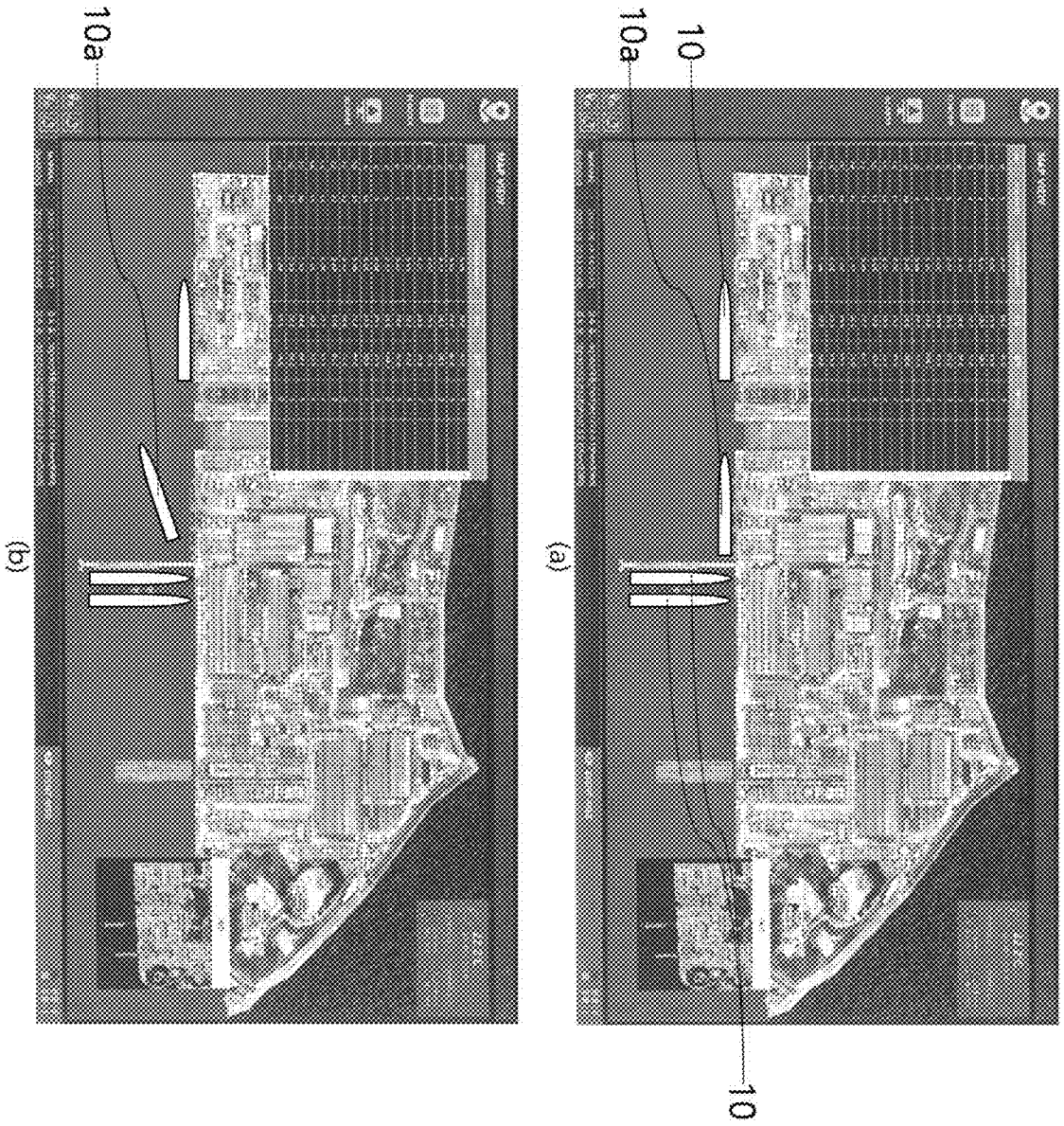
FIG. 11 shows ship indications on the display of the port management unit in one embodiment of the present disclosure.

FIG. 11 shows ship indications on the display of the port management unit in one embodiment of the present disclosure.

Referring to FIG. 11, the display of the port management unit applied to the method for monitoring the position of a ship capable of position monitoring may display ship indications 10 and 10*a* based on the actual map and direction in order to monitor the positions of the ships.

The map on which ship indications 10 and 10*a* may be displayed is displayed on the display screen, and the representation is implemented in a relative size proportional to the actual size based on the scale and coordinates of the map.

The ship indications 10 and 10*a* displayed on the map may be displayed in relative positions and sizes to correspond to the map based on the position data of the ships capable of position monitoring and the actual size data of the ships capable of position monitoring. For example, when the scale of the map on the display screen is changed, the sizes of the ship indications 10 and 10*a* also change accordingly.

In addition, the ship indications 10 and 10*a* may reflect the positions of the actual ships on the display screen in real time according to the method for monitoring the positions of the ships, capable of position monitoring, as described in FIG. 10. For example, in the method for monitoring the positions of the ships of the present disclosure, the position data for the initial position of the ship may be reflected and thus expressed as a ship indication (10*a* in FIG. 11(A)). Afterwards, the position of the ship changes, and accordingly, new position data is generated, and the relevant data is reflected so that it may be changed and displayed on the display screen as in a ship indication (10*a* in FIG. 11(B)).

FIGS. 12 and 13 show a portion of the display screen of the port management unit applied to a method for monitoring the position of a ship capable of position monitoring according to one embodiment of the present disclosure.

Referring to FIGS. 12A-12D, one or more alarm ranges may be set on the display screen of the port management unit applied to the method for monitoring the position of a ship, which is capable of position monitoring.

The ship is actually located at sea, but may be moored near land. At this time, if the ship unintentionally approaches the land or approaches the land at an excessive speed, there is a risk of damage to the ship, so it must be possible to monitor this and issue an alarm to the manager.

Figure 12A:
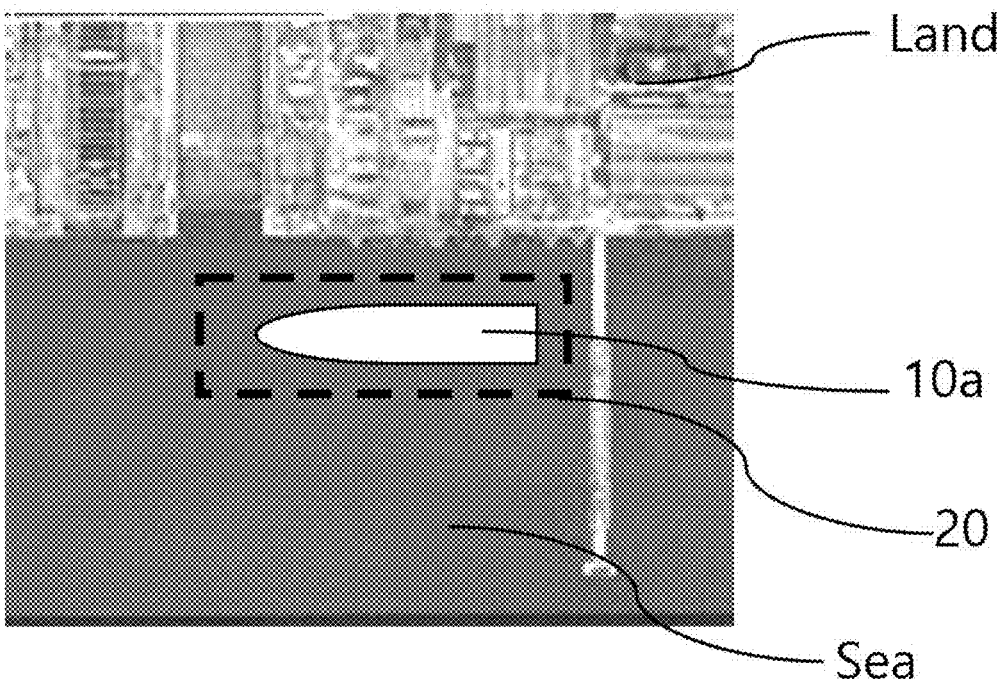
FIGS. 12A-12D and 13A-13D show a portion of the display screen of the port management unit applied to a method for monitoring the position of a ship capable of position monitoring according to one embodiment of the present disclosure.

Referring to FIG. 12(A), the display screen of the port management unit applied to the method for monitoring the position of a ship capable of position monitoring may display a ship indication 10*a* and a first alarm range 20. At this time, the ship indication 10*a* is displayed based on the actual position data of the ship capable of position monitoring, and the first alarm range 20 is virtually displayed on the display screen by forming a certain interval around the ship indication 10*a*, but it is implemented in a relative size proportional to the actual size based on the scale and coordinates of the map. For example, the first alarm range 20 is a value that may be set in advance by the manager, and may be designated and set by the manager depending on the marine environment and the number of ships anchored nearby.

Figure 12B:
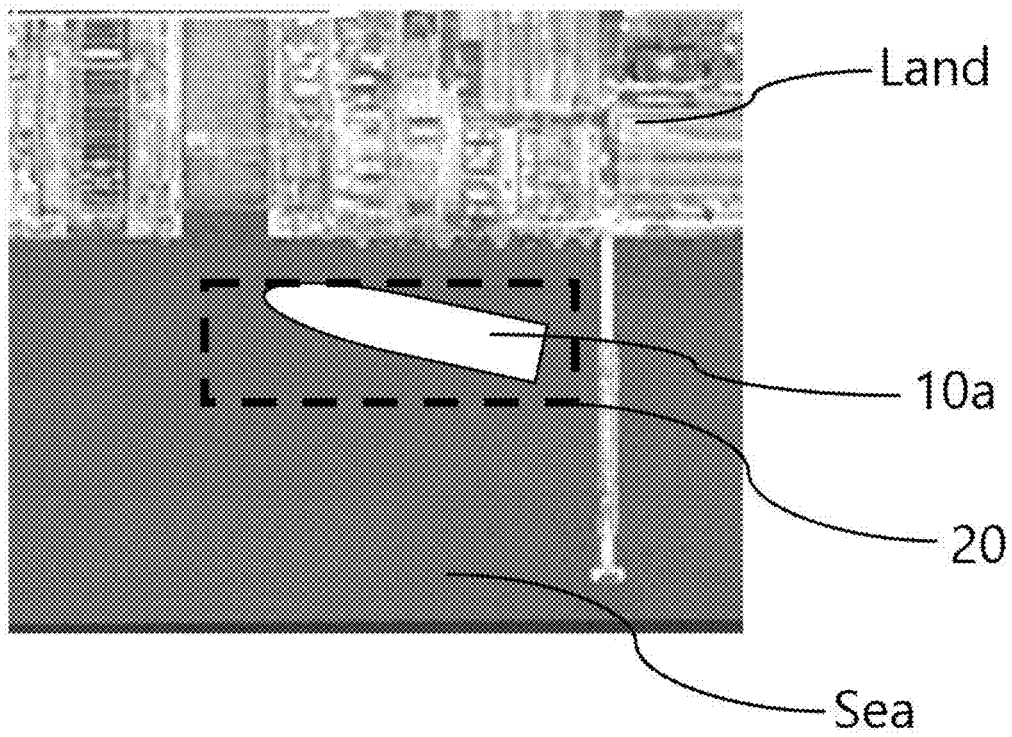

Afterwards, when the actual position of the ship changes as shown in FIG. 12(B), the position may change from the ship indication (10*a* in FIG. 12(A)) to the ship indication (10*a* in FIG. 12(B)) on the display screen. At this time, when the ship indication (10*a* in FIG. 12(B)) touches the first alarm range 20 or passes through the first alarm range 20, an alarm is disclosed as an indication or a sound on the display screen, and thus the manager may perceive it.

Figure 12C:
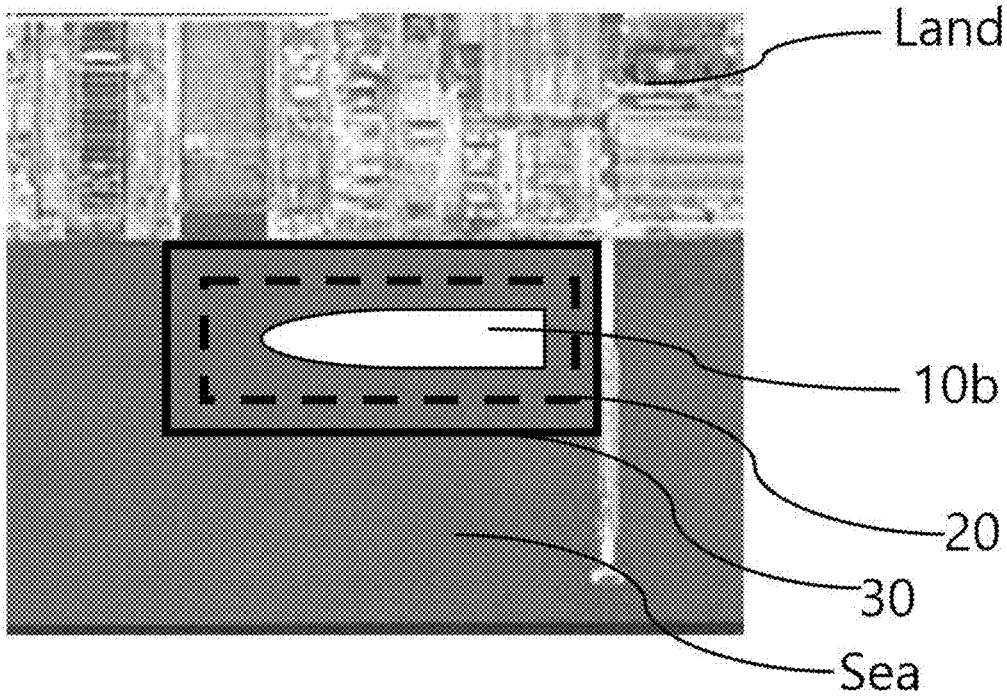

Referring to FIG. 12(C), a ship indication 10*b*, a first alarm range 20, and a second alarm range 30 outside the first alarm range 20 may be displayed on the display screen applied to the method for monitoring the position of a ship capable of position monitoring. At this time, the ship indication 10*b* is displayed based on the actual position data of the ship capable of position monitoring, and the first alarm range 20 and the second alarm range 30 are virtually displayed on the display screen by forming a certain interval around the ship indication 10*b*, but they are implemented in a relative size proportional to the actual size based on the scale and coordinates of the map.

Figure 12D:
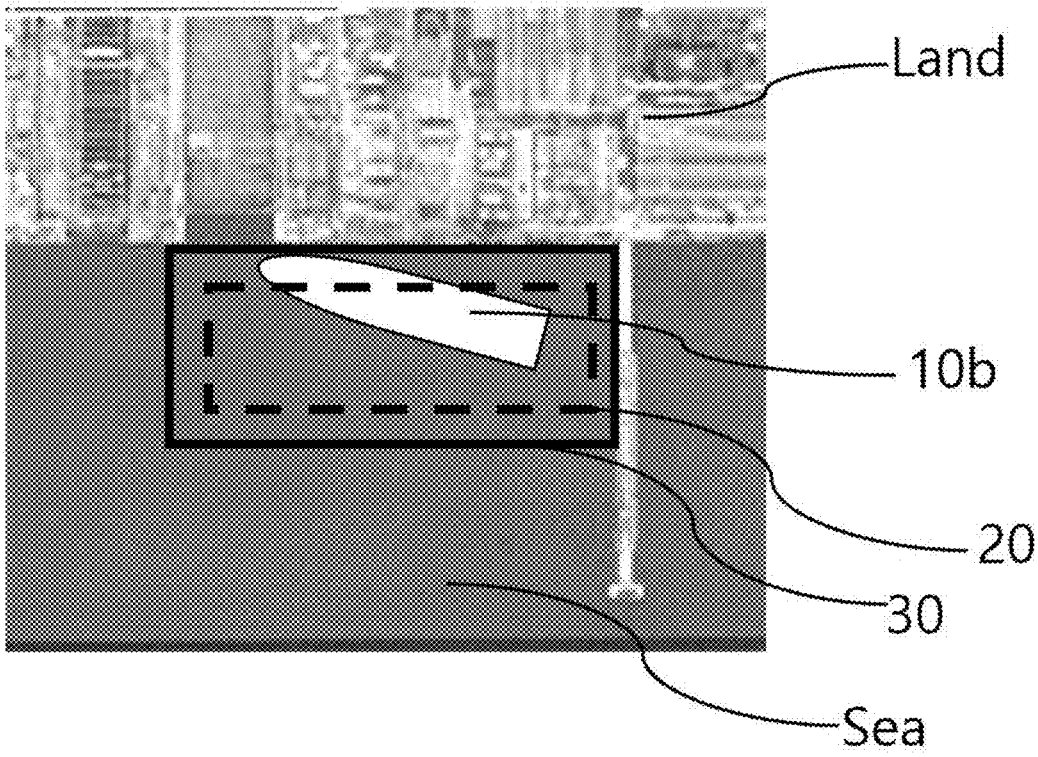

Afterwards, when the actual position of the ship changes as shown in FIG. 12(D), the position may change from the ship indication (10*b* in FIG. 12(C)) to the ship indication (10*b* in FIG. 12(D)) on the display screen. At this time, when the ship indication (10*b* in FIG. 12(D)) touches the first alarm range 20 or passes through the first alarm range 20, an alarm is disclosed as an indication or a sound on the display screen, and thus the manager may perceive it. In addition, when the ship indication (10*b* in FIG. 12(D)) passes through the first alarm range 20 and then touches the second alarm range 30, or passes through the second alarm range 30, a separate alarm is disclosed as an indication or a sound on the display screen, and thus the manager may perceive it.

Although not expressed in FIGS. 12A-12D, a plurality of alarm ranges can be set, and the shape of the alarm range can also be set in various shapes such as polygons and circles, but is not limited thereto.

Referring to FIGS. 13A-13D, one or more ship ranges in conjunction with the ship indication may be set on the display screen of the port management unit applied to the method for monitoring the position of a ship capable of position monitoring.

Figure 13A:
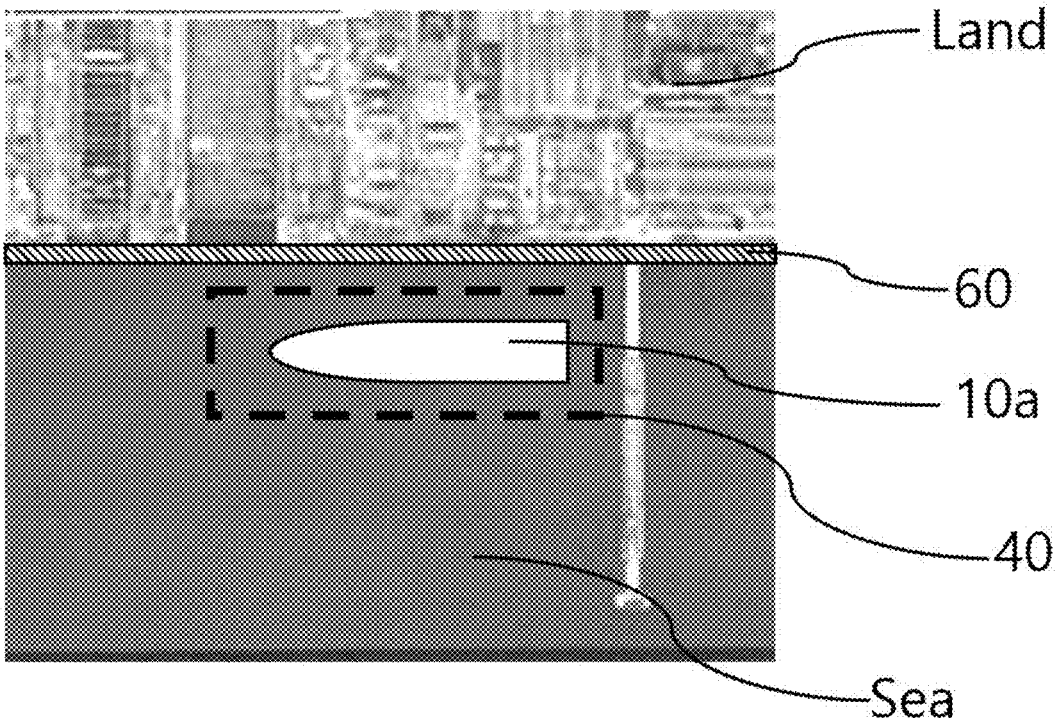

Referring to FIG. 13(A), a ship indication 10*a*, a first ship range 40, and an alarm boundary 60 may be displayed on the display screen of the port management unit applied to the method for monitoring the position of a ship capable of position monitoring. At this time, the ship indication 10*a* is displayed based on the actual position data of the ship capable of position monitoring, and the first ship range 40 is virtually displayed on the display screen by forming a certain interval around the ship indication 10*a*, but it is implemented in a relative size proportional to the actual size based on the scale and coordinates of the map, and is displayed in conjunction with the ship indication 10*a*. That is, the first ship range 40 may change together depending on the position and deflection changes of the ship.

Figure 13B:
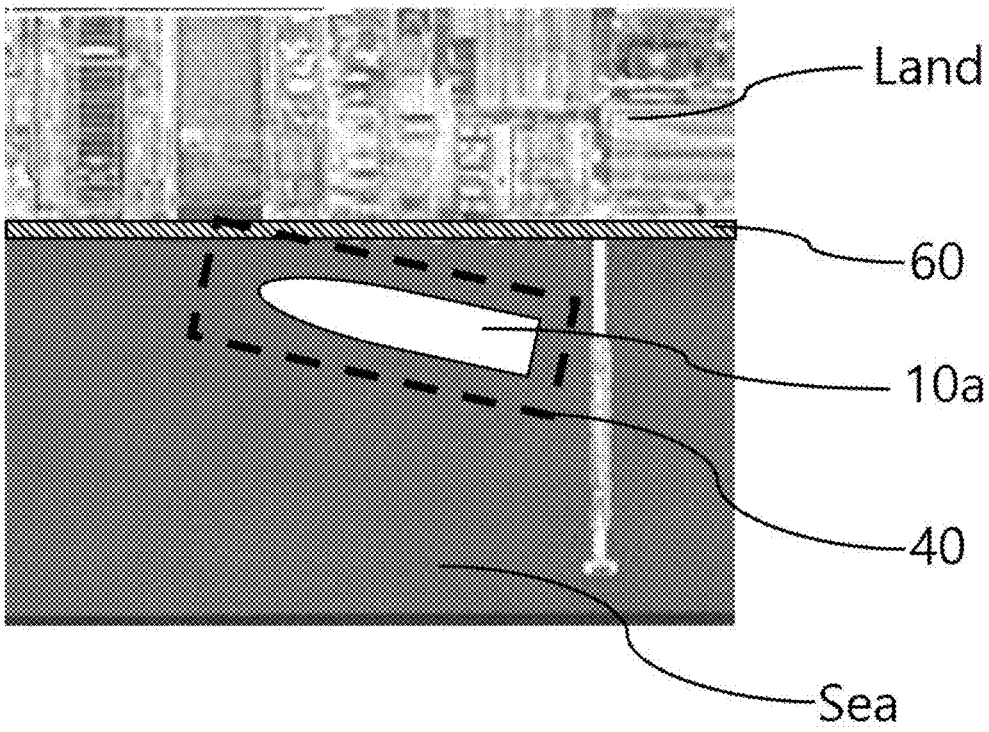

Afterwards, as shown in FIG. 13(B), the actual position of the ship capable of position monitoring changes, and thus the position may change from the ship indication (10*a* in FIG. 13(A)) to the ship indication (10*a* in FIG. 13(B)) on the display screen. At this time, when the position of the first ship range 40 of the ship indication (10*a* in FIG. 13(B)) also changes so that the first ship range 40 touches the alarm boundary 60 or passes through the alarm boundary 60, an alarm is disclosed as an indication or a sound on the display screen, and thus the manager may perceive it.

Figure 13C:
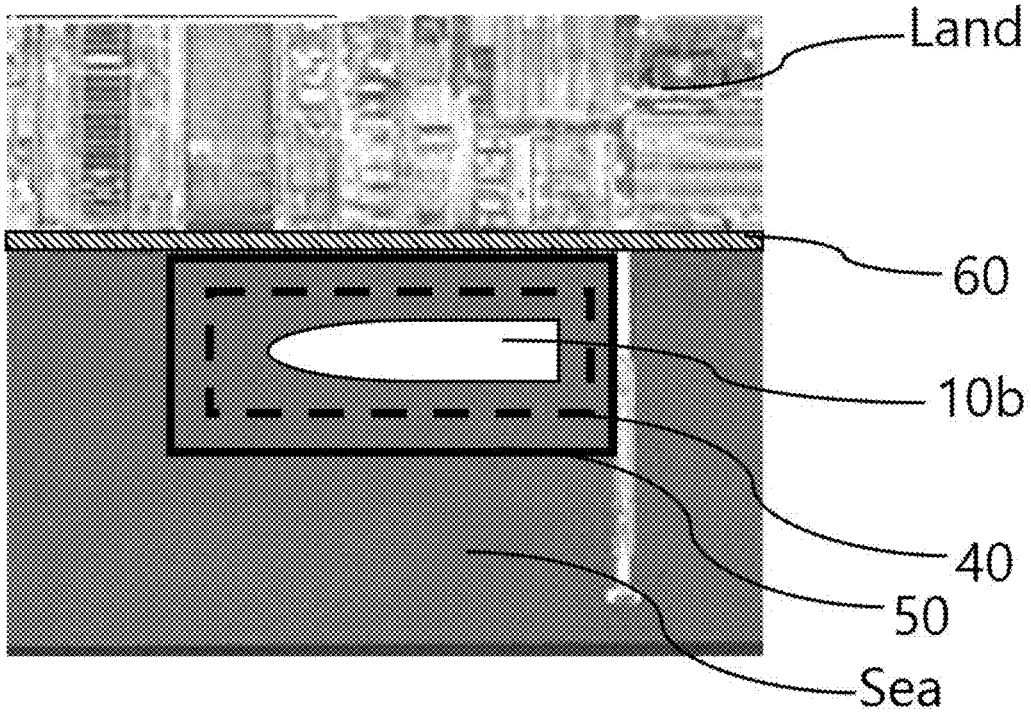

Referring to FIG. 13(C), a ship indication 10*b*, a first ship range 40, a second ship range 50 outside the first ship range 40, and an alarm boundary 60 may be displayed on the display screen applied to the method for monitoring the position of a ship capable of position monitoring. At this time, the ship indication 10*b* is displayed based on the actual position data of the ship capable of position monitoring, and the first ship range 40 and the second ship range 50 are virtually displayed on the display screen by forming a certain interval around the ship indication 10*b*, but they are implemented in a relative size proportional to the actual size based on the scale and coordinates of the map, and are displayed in conjunction with the ship indication 10*b*. That is, the first ship range 40 and the second ship range 50 may change together depending on the position and deflection changes of the ship.

Figure 13D:
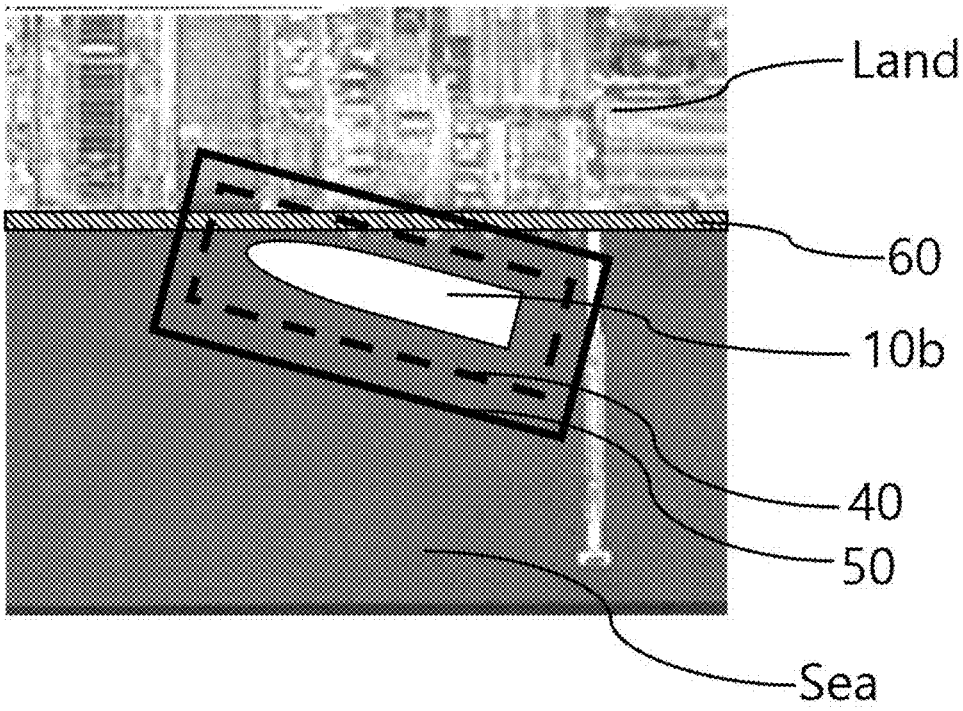

Afterwards, as shown in FIG. 13(D), the actual position of the ship capable of position monitoring changes, and thus the position may change from the ship indication (10*b* in FIG. 13(C)) to the ship indication (10*b* in FIG. 13(D)) on the display screen. At this time, when the position of the second ship range 50 of the ship indication (10*b* in FIG. 13(D)) also changes so that the second ship range 50 touches the alarm boundary 60 or passes through the alarm boundary 60, an alarm is disclosed as an indication or a sound on the display screen, and thus the manager may perceive it. In addition, when the position of the first ship range 40 of the ship indication (10*b* in FIG. 13(D)) also changes so that the first ship range 40 touches the alarm boundary 60 or passes through the alarm boundary 60, a separate alarm is disclosed as an indication or a sound on the display screen, and thus the manager may perceive it.

Although not expressed in FIGS. 13A-13D, pluralities of the ship ranges and alarm boundaries can be set, and the shape of the ship range can also be set in various shapes such as the same shape as the ship, polygons, and circles, but is not limited thereto. In addition, the alarm boundary can be set in various shapes such as the same shape as the ship, straight lines, curves, polygons, and circles, but is not limited thereto.

As described above, the specific description of the present disclosure has been made by the embodiments with reference to the accompanying drawings, but since the above-described embodiments have only been explained by referring to preferred examples of the present disclosure, it should not be understood that the present disclosure is limited to the above-described embodiments, and the scope of rights of the present disclosure should be understood as the claims to be described later and equivalent concepts thereof.

For example, drawings schematically show each of components as the main component to aid understanding, and the thickness, length, number, etc. of each component shown may differ from the actual ones during the drawing process. In addition, the materials, shapes, dimensions, etc. of each component shown in the above embodiments are only examples and are not particularly limited, and various changes are possible without substantially departing from the effect of the present disclosure.

EXPLANATION OF REFERENCE NUMERALS

1: Port monitoring system
2: Port management screen
10, 10*a*, 10*b*, 10*c*: Ship indication
20: First alarm range
30: Second alarm range
40: First ship range
50: Second ship range
60: Alarm boundary
70, 70*a*, 70*b*, 70*c*: Fender indication
80: Port environment indication
100: Ship
101: Bow part
102: Stern part
103: Central part
110: Ship monitoring unit
200: Fender
210: Fender monitoring unit
300: Port environment detection unit
400: Network
500: Port management unit
1000: First sensor
2000: Second sensor

The invention claimed is:

1. A port monitoring system comprising:

a port environment detector that measures environmental conditions of a port to generate port environment information;

a ship monitor installed at a ship to generate ship information of the ship;

a fender monitor installed at a fender to generate fender information of the fender; and a port management device configured to:

receive the port environment information generated by the port environment detector, the ship information generated by the ship monitor, and the fender information generated by the fender monitor; and monitor the ship and the fender using the port environment information, the ship information, and the fender information, wherein the port management device includes a display screen, one or more ship ranges, and an alarm boundary are set on the display screen of the port management device for monitoring a position of the ship, wherein the one or more ship ranges consist of a first ship range and subsequent ship ranges, with the first ship range comprises a boundary a preset distance interval around the ship indication and each subsequent ship range represents a boundary a preset distance from the previous ship range;

wherein an alarm is generated when the one or more ship ranges overlap with the alarm boundary; and wherein the alarm generated for the first ship range is different from the alarm generated for the subsequent ship ranges;

wherein the ship monitor includes:

a first sensor configured to measure a position value of a bow of the ship; and a second sensor configured to measure a position value of a stern of the ship, wherein the first and second sensors are configured to generate two-dimensional global coordinates of the bow and the stern of the ship as the position values, the first and second sensors are mounted on top portions of the bow and the stern of the ship which are opened to sky, respectively, and a distance between the first and second sensors is set to exceed twice a maximum measurement error distance of the first and second sensors, and wherein the first and second sensors are configured to:

perform position measurement for the bow and the stern of the ship at the same time; and transmit the measured position values of the bow and the stern of the ship to the port management device at the same time; and displayed in real time on the display screen in conjunction with the ship position data, and the fender indication is displayed in real time on the display screen in conjunction with the fender position data.

2. The port monitoring system of claim 1, wherein the ship monitor further includes:

a ship monitor communication module; and a ship monitor control module.

3. The port monitoring system of claim 1, wherein the fender monitor includes:

a fender sensor module;

a fender monitor communication module; and a fender monitor control module, wherein the fender sensor module includes a plurality of fender position sensors configured to generate fender position values.

4. The port monitoring system of claim 3, wherein the plurality of fender position sensors are configured to:

perform position measurement at the same time; and transmit the measured fender position values to the port management device at the same time.

5. The port monitoring system of claim 1, wherein the port management device includes a port management device control module that generates ship position data by processing the position values among the ship information using moving average formulas, and generates fender position data by processing fender position values among the fender information using the moving average formulas.

6. The port monitoring system of claim 5, wherein the ship position data and fender position data are processed using the moving average formulas $$D_{nx} = \left(\frac{1}{2^n}\right)x_1 + \frac{1}{2}\sum_{i=0}^{n-1}\left(\frac{1}{2}\right)^i x_{(n-i+1)}$$

$$D_{ny} = \left(\frac{1}{2^n}\right)y_1 + \frac{1}{2}\sum_{i=0}^{n-1}\left(\frac{1}{2}\right)^i y_{(n-i+1)}$$

$$D_{nz} = \left(\frac{1}{2^n}\right)z_1 + \frac{1}{2}\sum_{i=0}^{n-1}\left(\frac{1}{2}\right)^i z_{(n-i+1)}$$

(n=a natural number of 1 or more, and the larger the value of n, the more recent the position measurement value).

7. The port monitoring system of claim 5, wherein the port management device includes a port management device display module including the display screen for displaying a port map, displaying a ship indication of the ship in a relative size proportional to an actual size based on a scale and coordinates of the port map, and displaying a fender indication indicating a position of the fender based on the scale and the coordinates of the port map.

8. The port monitoring system of claim 7, wherein the port management device is configured to:

display the ship indication on the display screen of the port management device display module so that it is color-coded according to whether it is managed by the port management device;

link ship management information of the ship and ship information input from the port management device with the display screen, display the fender indication on the display screen so that it is color-coded according to whether it is managed by the port management device; and link fender management information of the fender and fender information input from the port management device with the display screen.

* * * * *